US010876229B2

(12) United States Patent
Fukuhara

(10) Patent No.: US 10,876,229 B2
(45) Date of Patent: Dec. 29, 2020

(54) CONDUCTIVE YARN STRUCTURE FOR INTERACTIVE TEXTILES

(71) Applicant: Google LLC, Mountain View, CA (US)

(72) Inventor: Shiho Fukuhara, Mountain View, CA (US)

(73) Assignee: Google LLC, Mountain View, CA (US)

( * ) Notice: Subject to any disclaimer, the term of this patent is extended or adjusted under 35 U.S.C. 154(b) by 403 days.

(21) Appl. No.: 15/799,208

(22) Filed: Oct. 31, 2017

(65) Prior Publication Data

US 2018/0258562 A1 Sep. 13, 2018

Related U.S. Application Data

(60) Provisional application No. 62/469,251, filed on Mar. 9, 2017.

(51) Int. Cl.

| | |
|---|---|
| ***D02G 3/44*** | (2006.01) |
| ***D02G 3/12*** | (2006.01) |
| ***D02G 3/36*** | (2006.01) |
| *D03D 15/00* | (2006.01) |

(52) U.S. Cl.

CPC ..... *D02G 3/441* (2013.01); *D02G 3/12* (2013.01); *D02G 3/36* (2013.01); *D03D 15/0066* (2013.01); *D03D 15/0083* (2013.01); *D10B 2331/04* (2013.01); *D10B 2331/10* (2013.01)

(58) Field of Classification Search

CPC ..... A41D 31/00; D02G 3/441

See application file for complete search history.

(56) References Cited

U.S. PATENT DOCUMENTS 3,288,175 A * 11/1966 Valko ..... A41D 31/265 139/425 R
5,802,607 A * 9/1998 Triplette ..... A63B 69/02 139/420 A
5,906,004 A * 5/1999 Lebby ..... A41D 31/00 139/425 R (Continued)

FOREIGN PATENT DOCUMENTS

JP 2001351766 12/2001
JP 2010020989 1/2010

(Continued)

OTHER PUBLICATIONS

International Search Report for PCT/US2017/059168 dated Feb. 28, 2018, 13 pages.

(Continued)

*Primary Examiner* — Tajash D Patel
(74) *Attorney, Agent, or Firm* — Dority & Manning, P.A.

(57) ABSTRACT

This document describes conductive yarn structures for interactive textiles. The conductive yarn structures of the interactive textile include a conductive core that includes at least one conductive filament and a cover layer that may be constructed from flexible threads that covers the conductive core. In one embodiment, the conductive core includes a plurality of conductive filaments. Each conductive filament can be made from a metallic composition containing copper and silver. Silver can be contained in the metallic composition in an amount from 0.5% by weight to 40% by weight. Each conductive filament can include an insulating sheath made from a polyurethane.

25 Claims, 18 Drawing Sheets

(56) References Cited

U.S. PATENT DOCUMENTS

| | | | | |
|---|---|---|---|---|
| 2010/0259925 | A1 | 10/2010 | Hsu et al. | |
| 2017/0325518 | A1* | 11/2017 | Poupyrev | D03D 1/0088 |
| 2019/0048494 | A1* | 2/2019 | Bogan | D03D 15/00 |

FOREIGN PATENT DOCUMENTS

| | | |
|---|---|---|
| WO | WO 97/24015 | 7/1997 |
| WO | WO2004/003273 | 1/2004 |
| WO | WO 2009/017362 | 2/2009 |
| WO | WO 2009/107905 | 9/2009 |
| WO | WO 2016/154561 | 9/2016 |

OTHER PUBLICATIONS

Written Opinion for Application No. PCT/US2017/059168, dated Feb. 5, 2019, 7 pages.
International Preliminary Report on Patentability for Application No. PCT/US2017/059168, dated Jun. 6, 2019, 22 pages.

* cited by examiner

CONDUCTIVE YARN STRUCTURE FOR INTERACTIVE TEXTILES

RELATED APPLICATIONS

The present application claims priority to U.S. Provisional Patent Application Ser. No. 62/469,251, filed on Mar. 9, 2017, which is incorporated herein by reference.

BACKGROUND

Currently, producing touch sensors can be complicated and expensive, especially if the touch sensor is intended to be light, flexible, or adaptive to various different kinds of use. Conventional touch pads, for example, are generally non-flexible and relatively costly to produce and to integrate into objects.

SUMMARY

This document describes conductive yarn for interactive textiles. An interactive textile includes a plurality of conductive yarns woven into the interactive textile to form a capacitive touch sensor that is configured to detect touch-input. The interactive textile can process the touch-input to generate touch data that is useable to initiate functionality at various remote devices that are wirelessly coupled to the interactive textile. For example, the interactive textile may aid users in controlling volume on a stereo, pausing a movie playing on a television, or selecting a webpage on a desktop computer. Due to the flexibility of textiles, the interactive textile may be easily integrated within flexible objects, such as clothing, shoes, handbags, fabric casings, hats, and so forth.

In one or more implementations, the interactive textile includes a plurality of conductive yarns woven into the textile. For example, in one embodiment, the conductive yarns are in a parallel relationship within the textile. In an alternative embodiment, the conductive yarns may form a grid in which a first set of yarns are woven into a top textile layer and a second set of yarns are woven into a bottom textile layer. In either embodiment, the conductive yarns form a capacitive touch sensor that is configured to detect touch-input. The capacitive touch sensor can be in communication with electronic components, such as a controller, a wireless interface, an output device (e.g., an LED, a display, or speaker), and so forth.

In one or more implementations, the conductive yarn may comprise a conductive core including at least one conductive filament. In accordance with the present disclosure, the conductive filament can be made from a metallic material comprising copper and silver. For example, in one embodiment, more copper can be contained in the metallic material than silver. Combining copper with silver in this manner has been found to produce a conductive filament able to withstand a weaving process, laundry cycles once the interactive textile has been produced, and any other forces that a textile may be subjected to when the textile is being worn by the user. In one embodiment, for instance, the metallic material used to make the conductive filament may contain greater than about 1% by weight silver, such as greater than about 2% by weight silver, such as greater than about 5% by weight silver, such as greater than about 8% by weight silver, such as greater than about 10% by weight silver. The conductive filament generally contains less than about 40% by weight silver, such as less than about 30% by weight silver, such as less than about 25% by weight silver, such as less than about 20% by weight silver, such as less than 18% by weight silver, such as less than about 15% by weight silver. The values of the silver weight percentages are here stated with some uncertainty, e.g. about 1% weight silver e.g. due to measurement errors. The values given also refer to the numerically definite values, e.g. 1% weight silver. In one embodiment, the metallic material comprises a copper and silver alloy only containing copper and silver. The composition of the metallic material allows for very thin conductive filaments to be produced. For instance, the conductive filaments can have a diameter of less than about 0.2 mm, such as less than about 0.15 mm, such as less than about 0.1 mm, such as less than about 0.08 mm. The diameter is generally greater than about 0.02 mm, such as greater than about 0.04 mm. The values for the diameter are here stated with some uncertainty, e.g. about 0.15 mm due e.g. to measurement errors. The values also refer to the numerically definite values, e.g. 0.15 mm.

In one embodiment, the conductive core of the yarn is made from a plurality of the conductive filaments. For instance, the conductive core may contain from about 8 to about 18 conductive filaments, such as from about 10 to about 14 conductive filaments. The values for numbers are here stated with some uncertainty, e.g. about 10 conductive filaments. The values also refer to the numerically definite values, e.g. 10 conductive filaments.

In one embodiment, each filament can include an insulating sheath surrounding the metallic filament. The insulating sheath, for instance, may comprise a polymer layer that forms a tubular structure around the conductive filament. The polymer layer may comprise a polyurethane polymer.

The conductive yarn can further include an outer cover layer that surrounds the conductive core. In one embodiment, the outer cover layer comprises flexible threads braided around the conductive core. The flexible threads may comprise, for instance, silk threads, polyester threads, cotton threads, wool threads, nylon threads, and mixtures thereof. In one embodiment, the flexible threads comprise preshrunk polyester threads.

In an alternative embodiment, the conductive yarn of the present disclosure comprises a yarn configured to be integrated into an interactive textile. The conductive yarn comprises a conductive core containing from about 8 to about 18 conductive filaments. The values for numbers are here stated with some uncertainty, e.g. about 10 conductive filaments. The values also refer to the numerically definite values, e.g. 10 conductive filaments.

Each conductive filament is surrounded by a polymeric insulating layer. Each filament comprises a metallic material. An outer cover layer surrounds the conductive core and comprises flexible threads that have been braided around the conductive core. As described above, in one embodiment, each filament contained within the conductive core can be made from a copper and silver alloy.

The present disclosure is also directed to an interactive textile integrated with a flexible object. The interactive textile comprises a plurality of conductive yarns woven into the interactive textile to form a capacitive touch sensor. The conductive yarns comprise any of the conductive yarns described above.

The interactive textile further includes a textile controller coupled to the capacitive touch sensor. The textile controller is configured to detect touch-input to the capacitive touch sensor when an object touches the capacitive touch sensor. The controller is further configured to process the touch-input to provide touch data useable to control a computing device or an application at the computing device.

This summary is provided to introduce simplified concepts concerning conductive yarn structures for interactive textiles, which is further described below in the Detailed Description. This summary is not intended to identify essential features of the claimed subject matter, nor is it intended for use in determining the scope of the claimed subject matter.

BRIEF DESCRIPTION OF THE DRAWINGS

Embodiments of techniques and devices for conductive yarn structures for interactive textiles are described with reference to the following drawings. The same numbers are used throughout the drawings to reference like features and components.

DETAILED DESCRIPTION

Overview

Figure 1:
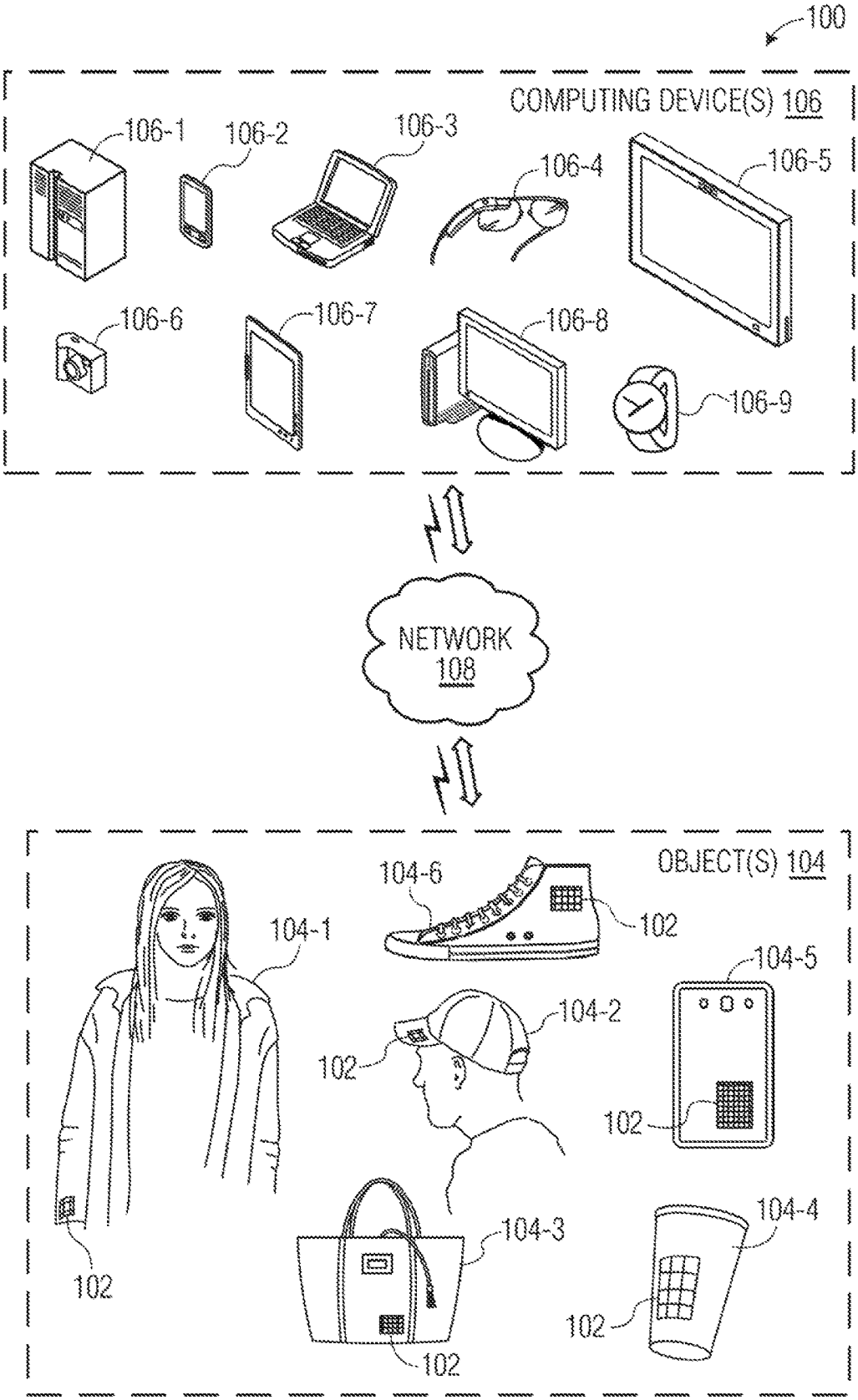
FIG. 1 is an illustration of an example environment in which techniques using, and an objects including, an interactive textile may be embodied.

Currently, producing touch sensors can be complicated and expensive, especially if the touch sensor is intended to be light, flexible, or adaptive to various different kinds of use. This document describes techniques using, and objects embodying, interactive textiles which are configured to sense multi-touch-input. To enable the interactive textiles to sense multi-touch-input, a plurality of conductive yarns are woven into the interactive textile to form a capacitive touch sensor that can detect touch-input. The interactive textile can process the touch-input to generate touch data that is useable to initiate functionality at various remote devices. For example, the interactive textiles may aid users in controlling volume on a stereo, pausing a movie playing on a television, or selecting a webpage on a desktop computer. Due to the flexibility of textiles, the interactive textile may be easily integrated within flexible objects, such as clothing, handbags, fabric casings, hats, shoes, and so forth.

In one or more implementations, the interactive textile includes a plurality of conductive yarns that are woven into a fabric that forms a textile. The plurality of conductive yarns can be spaced from each other in any suitable configuration suitable to form a capacitive touch sensor that is configured to detect touch-input. The capacitive touch sensor can be in communication with an electronic component, such as a controller, a wireless interface, an output device, or the like.

In one or more implementations, the conductive yarn of the interactive textile includes a conductive core that includes at least one conductive filament and a cover layer that covers the conductive core. For example, in one embodiment, the conductive yarn comprises a conductive core made from a plurality of conductive filaments. Each filament can be enclosed within an insulating sheath. The filaments can be made from a metallic composition. For instance, in one embodiment, the metallic composition may comprise a copper and silver alloy that results in the ability to produce a very flexible, thin filament that can be incorporated into a textile without substantially increasing the stiffness of the textile product and without even being noticed by the user. The cover layer that covers the conductive core can comprise a polymeric sheath or a fabric sheath. In one embodiment, for instance, the outer cover can be formed by braiding flexible threads together around the conductive core. The flexible threads can be made from any suitable natural or synthetic fiber. In one embodiment, for instance, the threads can be made from preshrunk polyester fibers.

In one or more implementations, a gesture manager is implemented at a computing device that is wirelessly coupled to the interactive textile. The gesture manager enables the user to create gestures and assign the gestures to various functionalities of the computing device. The gesture manager can store mappings between the created gestures and the functionalities in a gesture library to enable the user to initiate a functionality, at a subsequent time, by inputting a gesture assigned to the functionality into the interactive textile.

In one or more implementations, the gesture manager is configured to select a functionality based on both a gesture to the interactive textile and a context of the computing device. The ability to recognize gestures based on context enables the user to invoke a variety of different functionalities using a subset of gestures. For example, for a first context, a first gesture may initiate a first functionality, whereas for a second context, the same first gesture may initiate a second functionality.

In one or more implementations, the interactive textile is coupled to one or more output devices (e.g., a light source, a speaker, or a display) that is integrated within the flexible object. The output device can be controlled to provide notifications initiated from the computing device and/or feedback to the user based on the user's interactions with the interactive textile.

Example Environment

FIG. 1 is an illustration of an example environment 100 in which techniques using, and objects including, an interactive textile may be embodied. Environment 100 includes an interactive textile 102, which is shown as being integrated within various objects 104. Interactive textile 102 is a textile that is configured to sense multi-touch input. As described herein, a textile corresponds to any type of flexible woven material consisting of a network of natural or artificial fibers, often referred to as thread or yarn. Textiles may be formed by weaving, knitting, crocheting, knotting, or pressing threads together. Textiles also include nonwovens.

In environment 100, objects 104 include "flexible" objects, such as a shirt 104-1, a hat 104-2, a handbag 104-3 and a shoe 104-6. It is to be noted, however, that interactive textile 102 may be integrated within any type of flexible object made from fabric or a similar flexible material, such as articles of clothing, shoes, blankets, shower curtains, towels, sheets, bed spreads, or fabric casings of furniture, to name just a few. As discussed in more detail below, interactive textile 102 may be integrated within flexible objects 104 in a variety of different ways, including weaving, sewing, gluing, and so forth.

In this example, objects 104 further include "hard" objects, such as a plastic cup 104-4 and a hard smart phone casing 104-5. It is to be noted, however, that hard objects 104 may include any type of "hard" or "rigid" object made from non-flexible or semi-flexible materials, such as plastic, metal, aluminum, and so on. For example, hard objects 104 may also include plastic chairs, water bottles, plastic balls, or car parts, to name just a few. Interactive textile 102 may be integrated within hard objects 104 using a variety of different manufacturing processes. In one or more implementations, injection molding is used to integrate interactive textiles 102 into hard objects 104.

Interactive textile 102 enables a user to control object 104 that the interactive textile 102 is integrated with, or to control a variety of other computing devices 106 via a network 108. Computing devices 106 are illustrated with various non-limiting example devices: server 106-1, smart phone 106-2, laptop 106-3, computing spectacles 106-4, television 106-5, camera 106-6, tablet 106-7, desktop 106-8, and smart watch 106-9, though other devices may also be used, such as home automation and control systems, sound or entertainment systems, home appliances, security systems, netbooks, and e-readers. Note that computing device 106 can be wearable (e.g., computing spectacles and smart watches), non-wearable but mobile (e.g., laptops and tablets), or relatively immobile (e.g., desktops and servers).

Network 108 includes one or more of many types of wireless or partly wireless communication networks, such as a local-area-network (LAN), a wireless local-area-network (WLAN), a personal-area-network (PAN), a wide-area-network (WAN), an intranet, the Internet, a peer-to-peer network, point-to-point network, a mesh network, and so forth.

Interactive textile 102 can interact with computing devices 106 by transmitting touch data through network 108. Computing device 106 uses the touch data to control computing device 106 or applications at computing device 106. As an example, consider that interactive textile 102 integrated at shirt 104-1 may be configured to control the user's smart phone 106-2 in the user's pocket, television 106-5 in the user's home, smart watch 106-9 on the user's wrist, or various other appliances in the user's house, such as thermostats, lights, music, and so forth. For example, the user may be able to swipe up or down on interactive textile 102 integrated within the user's shirt 104-1 to cause the volume on television 106-5 to go up or down, to cause the temperature controlled by a thermostat in the user's house to increase or decrease, or to turn on and off lights in the user's house. Note that any type of touch, tap, swipe, hold, or stroke gesture may be recognized by interactive textile 102.

Figure 2:
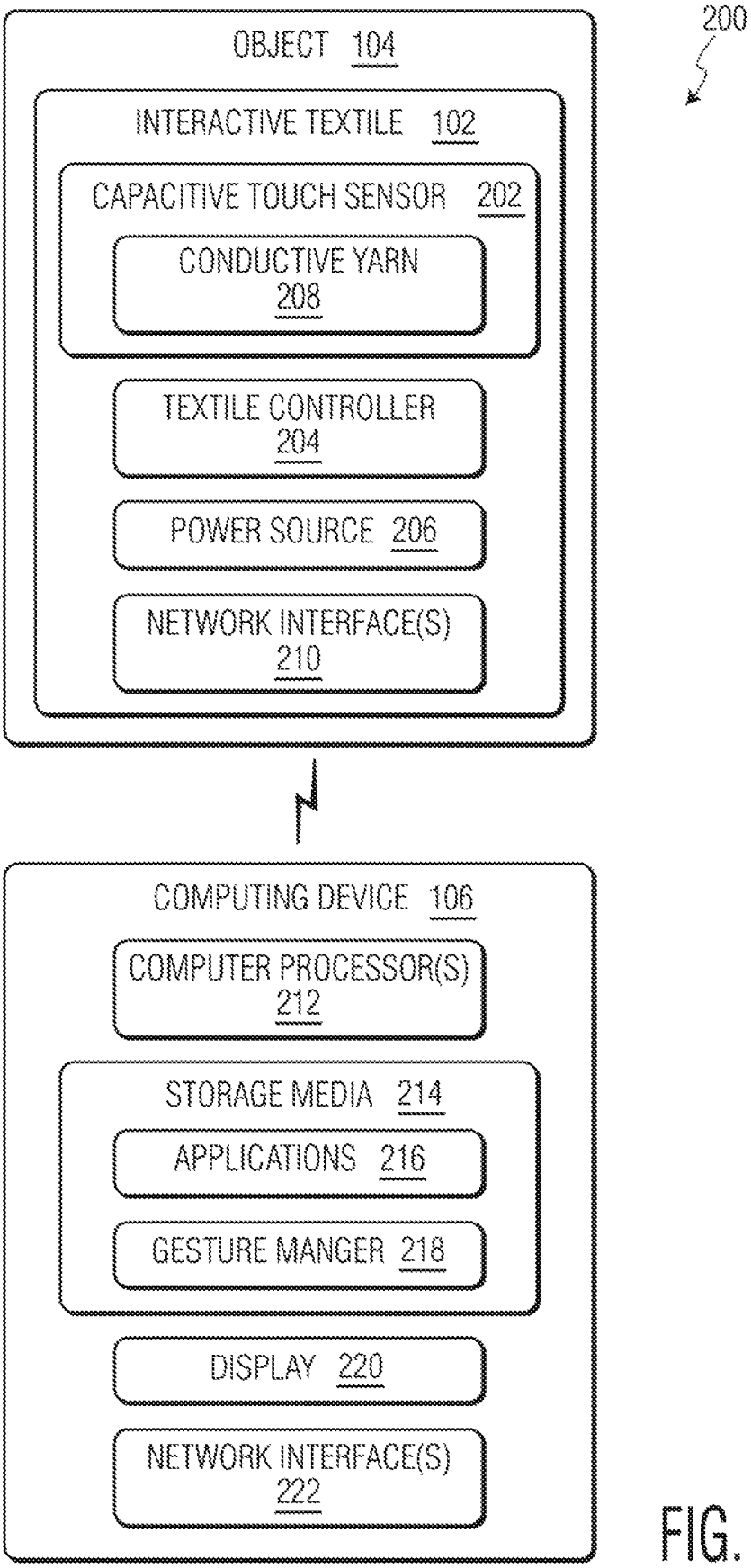
FIG. 2 illustrates an example system that includes an interactive textile and a gesture manager.

In more detail, consider FIG. 2 which illustrates an example system 200 that includes an interactive textile and a gesture manager. In system 200, interactive textile 102 is integrated in an object 104, which may be implemented as a flexible object (e.g., shirt 104-1, hat 104-2, or handbag 104-3) or a hard object (e.g., plastic cup 104-4 or smart phone casing 104-5).

Interactive textile 102 is configured to sense multi-touch-input from a user when one or more fingers of the user's hand touch interactive textile 102. Interactive textile 102 may also be configured to sense full-hand touch input from a user, such as when an entire hand of the user touches or swipes interactive textile 102. To enable this, interactive textile 102 includes a capacitive touch sensor 202, a textile controller 204, and a power source 206.

Capacitive touch sensor 202 is configured to sense touch-input when an object, such as a user's finger, hand, or a conductive stylus, approaches or makes contact with capacitive touch sensor 202. Unlike conventional hard touch pads, capacitive touch sensor 202 uses a plurality or pattern of conductive yarn 208 woven into interactive textile 102 to sense touch-input. Thus, capacitive touch sensor 202 does not alter the flexibility of interactive textile 102, which enables interactive textile 102 to be easily integrated within objects 104.

Power source 206 is coupled to textile controller 204 to provide power to textile controller 204, and may be implemented as a small battery. Textile controller 204 is coupled to capacitive touch sensor 202. For example, wires from the conductive yarns 208 may be connected to textile controller 204 using flexible PCB, creping, gluing with conductive glue, soldering, and so forth.

In one or more implementations, interactive textile 102 (or object 104) may also include one or more output devices, such as light sources (e.g., LED's), displays, or speakers. In this case, the output devices may also be connected to textile controller 204 to enable textile controller 204 to control their output.

Textile controller 204 is implemented with circuitry that is configured to detect the location of the touch-input on the grid of conductive yarn 208, as well as motion of the touch-input. When an object, such as a user's finger, touches capacitive touch sensor 202, the position of the touch can be determined by controller 204 by detecting a change in capacitance on the pattern of conductive yarn 208. Textile controller 204 uses the touch-input to generate touch data usable to control computing device 102. For example, the touch-input can be used to determine various gestures, such as single-finger touches (e.g., touches, taps, and holds), multi-finger touches (e.g., two-finger touches, two-finger taps, two-finger holds, and pinches), single-finger and multi-finger swipes (e.g., swipe up, swipe down, swipe left, swipe right), and full-hand interactions (e.g., touching the textile with a user's entire hand, covering textile with the user's entire hand, pressing the textile with the user's entire hand, palm touches, and rolling, twisting, or rotating the user's hand while touching the textile). Capacitive touch sensor 202 may be implemented as a self-capacitance sensor, or a projective capacitance sensor, which is discussed in more detail below.

Object 104 may also include network interfaces 210 for communicating data, such as touch data, over wired, wireless, or optical networks to computing devices 106. By way of example and not limitation, network interfaces 210 may communicate data over a local-area-network (LAN), a wireless local-area-network (WLAN), a personal-area-network (PAN) (e.g., Bluetooth™), a wide-area-network (WAN), an intranet, the Internet, a peer-to-peer network, point-to-point network, a mesh network, and the like (e.g., through network 108 of FIG. 1).

In this example, computing device 106 includes one or more computer processors 212 and computer-readable storage media (storage media) 214. Storage media 214 includes applications 216 and/or an operating system (not shown) embodied as computer-readable instructions executable by computer processors 212 to provide, in some cases, functionalities described herein. Storage media 214 also includes a gesture manager 218 (described below).

Computing device 106 may also include a display 220 and network interfaces 222 for communicating data over wired, wireless, or optical networks. For example, network interfaces 222 can receive touch data sensed by interactive textile 102 from network interfaces 210 of object 104. By way of example and not limitation, network interface 222 may communicate data over a local-area-network (LAN), a wireless local-area-network (WLAN), a personal-area-network (PAN) (e.g., Bluetooth™), a wide-area-network (WAN), an intranet, the Internet, a peer-to-peer network, point-to-point network, a mesh network, and the like.

Gesture manager 218 is capable of interacting with applications 216 and interactive textile 102 effective to activate various functionalities associated with computing device 106 and/or applications 216 through touch-input (e.g., gestures) received by interactive textile 102. Gesture manager 218 may be implemented at a computing device 106 that is local to object 104, or remote from object 104.

Having discussed a system in which interactive textile 102 can be implemented, now consider a more-detailed discussion of interactive textile 102.

Figure 3:
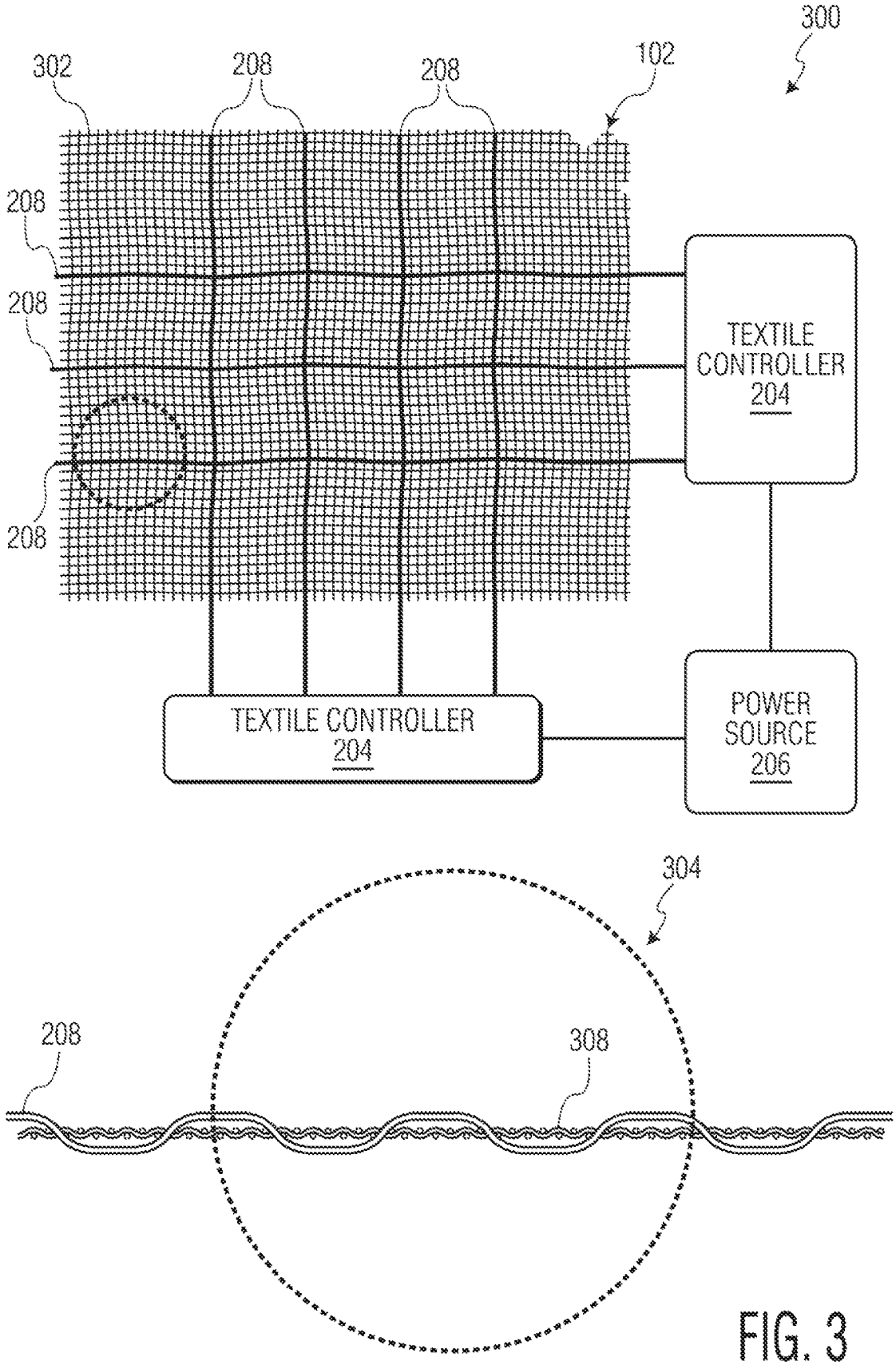
FIG. 3 illustrates an example of an interactive textile in accordance with one or more implementations.

FIG. 3 illustrates an example 300 of interactive textile 102 in accordance with one or more implementations. In this example, interactive textile 102 includes non-conductive threads or yarns 302 woven with conductive yarns 208 to form interactive textile 102. Non-conductive threads 302 may correspond to any type of non-conductive thread, fiber, or fabric, such as cotton, wool, silk, nylon, polyester, and so forth.

At 304, a zoomed-in view of conductive yarn 208 is illustrated. Conductive yarn 208 is integrated into fabric 308. Weaving or knitting conductive yarn 208 with the flexible threads to form fabric 308 causes conductive yarn 208 to be flexible and stretchy, which enables conductive yarn 208 to be easily woven or knitted with the non-conductive threads to form interactive textile 102.

Figure 4:
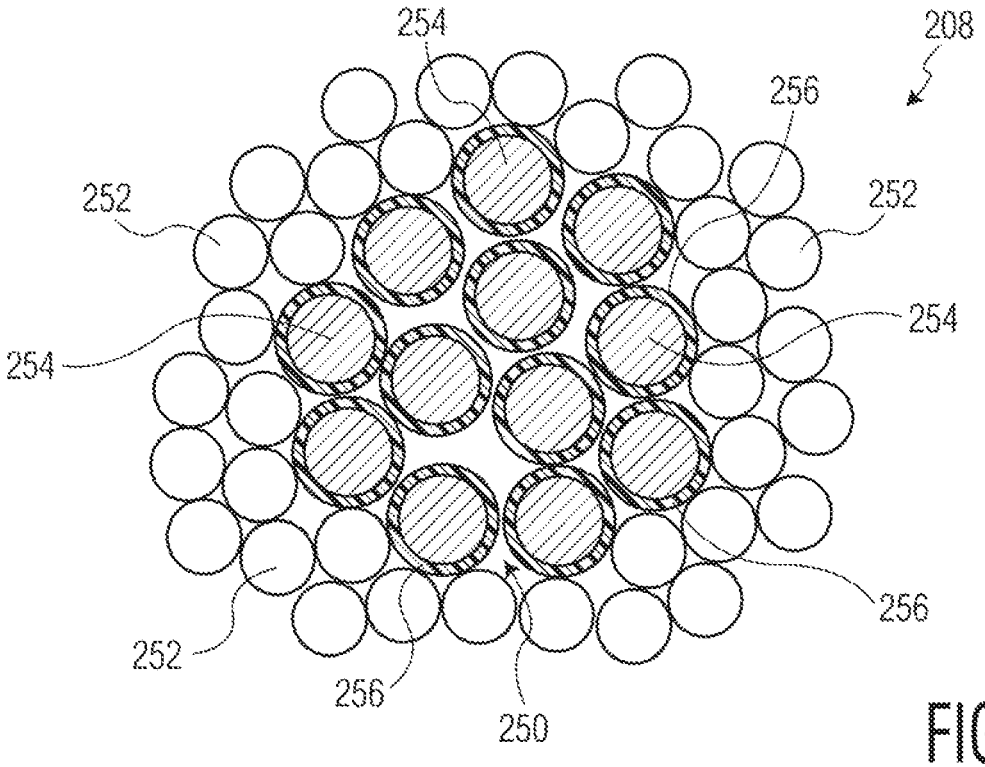
FIG. 4 which illustrates an example of a conductive core for a conductive yarn in accordance with one or more implementations.
Figure 5:
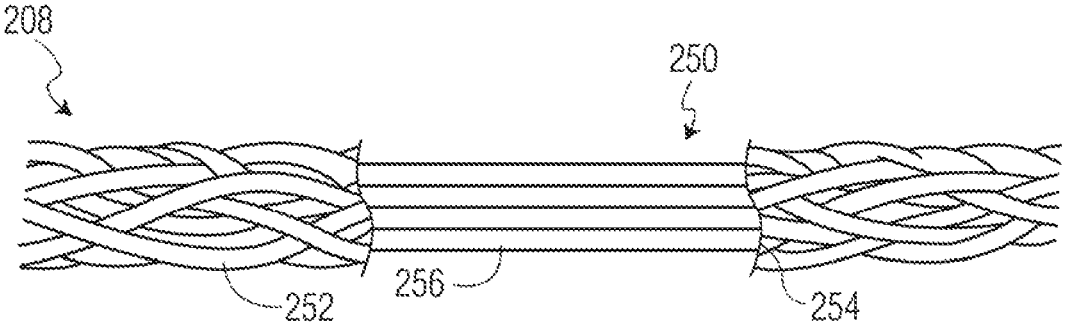
FIG. 5 illustrates an example of a conductive yarn with cut away portions in accordance with one or more implementations.
Figure 6:
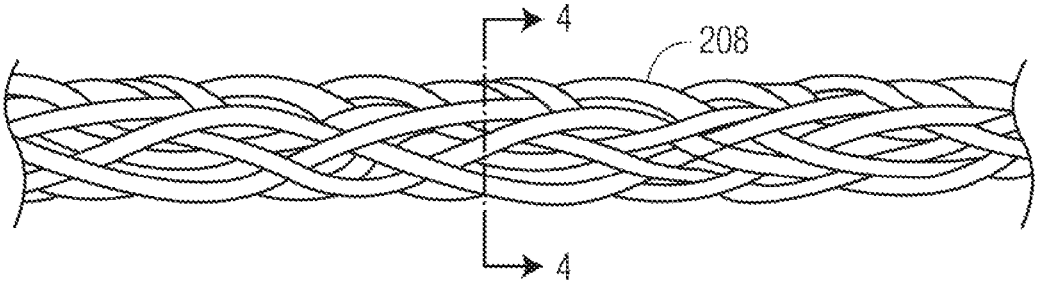
FIG. 6 illustrates an example of conductive yarns in accordance with one or more implementations.

Referring to FIGS. 4, 5 and 6, one embodiment of a conductive yarn 208 made in accordance with the present disclosure is illustrated in greater detail. FIG. 4, for instance, illustrates a cross-section of a conductive yarn 208 made in accordance with the present disclosure. FIG. 6 illustrates a side view of the conductive yarn 208, while FIG. 5 illustrates a side view of the conductive yarn 208 with cut away portions showing a conductive core 250. The conductive core 250 is surrounded by an outer cover layer 252. The outer cover layer 252 can be non-conductive.

As shown in FIG. 4, the conductive core 250 is made from a plurality of conductive filaments 254. Each conductive filament 254 is made from a conductive material. For instance, in one embodiment, each conductive filament 254 can be made from a conductive metallic material, such as a pure metal or a metal alloy. Metals that may be used to produce the conductive filament 254 include silver, gold, copper, and the like.

In one embodiment, each conductive filament 254 is made from a metallic material containing copper and silver. Copper can be present in the material in a greater amount than the silver. In one embodiment, the conductive filaments 254 are made from a copper and silver alloy. The copper and silver alloy, for instance, may only contain copper and silver.

In accordance with the present disclosure, silver is combined with the copper to produce the conductive filament 254 in a manner that increases flexibility and thereby reduces the likelihood of filament breakage during weaving or knitting of the interactive textile. Filaments made in accordance with the present disclosure are also capable of withstanding normal wear of the interactive textile and repeated laundry cycles.

For instance, in one embodiment, the metallic material used to produce the conductive filaments 254 can contain copper and silver, wherein silver is present in the filaments in an amount greater than about 1% by weight, such as in an amount greater than about 2% by weight, such as in an amount greater than about 5% by weight, such as in an amount greater than about 8% by weight, such as in an amount greater than about 10% by weight. The amount of silver contained in the conductive filaments 254 is generally less than about 40% by weight, such as in an amount less than about 35% by weight, such as in an amount less than about 30% by weight, such as in an amount less than about 25% by weight, such as in an amount less than about 20% by weight, such as in an amount less than about 15% by weight. In one embodiment, for instance, each filament 254 can comprise copper and silver wherein silver is present in the copper and silver alloy in an amount from about 10% to about 14% by weight, such as from about 11% to about 13% by weight.

As described above, the above combination of copper and silver has been found to produce conductive filaments with dramatically improved physical properties. In addition, the material allows for the production of ultra-thin filaments that are still well suited for carrying an electric current. For instance, each conductive filament 254 can have a filament diameter of less than about 0.12 mm, such as less than about 0.1 mm, such as less than about 0.08 mm. For instance, the filament can have a diameter of less than about 0.075 mm, such as less than about 0.07. The filament diameter is generally greater than about 0.01 mm, such as greater than about 0.02 mm. In one embodiment, the filaments 254 have a filament diameter of from about 0.04 mm to less than about 0.08 mm, such as from about 0.04 mm to about 0.06 mm. In one particular embodiment, for instance, the filaments have a filament diameter of about 0.05 mm.

As shown in FIG. 4, the conductive core 250 includes a plurality of conductive filaments 254. By placing a plurality of conductive filaments 254 within the conductive yarn 208, although unlikely, some of the filaments can break during use and the conductive yarn 208 will continue to operate and function properly. The number of conductive filaments 254 contained within the conductive core 250 can depend upon various factors. For instance, in one embodiment, as many conductive filaments 254 as possible can be placed within the conductive core 250 while still producing an overall conductive yarn 208 having a diameter and size that substantially matches other yarns and threads used to produce the textile product.

In one embodiment, for instance, the conductive core 250 can contain at least four conductive filaments, such as at least six conductive filaments, such as at least eight conductive filaments, such as at least ten conductive filaments. The conductive core 250 generally contains less than about 20 conductive filaments, such as less than about 18 conductive filaments, such as less than about 16 conductive filaments, such as less than about 14 conductive filaments. In one particular embodiment, for instance, the conductive core 250 as shown in FIG. 4 contains 12 conductive filaments 254.

As shown in FIG. 4, each conductive filament 254 can be surrounded by an insulating sheath 256. The insulating sheath 256, for instance, can comprise a polymer layer that forms a tubular structure around the conductive filament 254. In general, the insulating sheath 256 can be made from any suitable polymer material capable of electrically insulating the conductive filament 254. For example, the insulating sheath 254 can be made from a polyester elastomer, a rubber, or any other suitable elastomeric material. In one particular embodiment, for instance, the insulating sheath 256 can be made from a polyurethane polymer.

The conductive filaments 254 are assembled together to form the conductive core 250. In one embodiment, the plurality of conductive filaments 254 have very few twists when combined together. For instance, the conductive core 250 may include less than ten twists per meter, such as less than about five twists per meter, such as less than about three twists per meter, such as less than about two twists per meter, such as even less than about one twist per meter.

The conductive core 250, as described above, is surrounded by an outer cover layer 252. The outer cover layer 252 can be designed to insulate the conductive filaments 254. The outer cover layer 252 can also be used to camouflage the conductive yarns 208 within a textile product and/or to change the outer appearance and feel of the conductive yarn 208.

In one embodiment, when the outer cover layer 252 is used to insulate the conductive core 250, the conductive core 250 can be coated with a material such as enamel or nylon.

Alternatively, as shown in FIGS. 4-6, the outer cover layer 252 of the conductive yarn 208 may comprise a plurality of non-conductive threads that have been braided around the conductive core 250. For example, in one or more implementations, the cover layer is constructed by wrapping flexible threads (e.g., polyester threads, cotton threads, wool threads, or silk threads) around the conductive core. For example, the cover layer may be formed by wrapping threads around the conductive core at approximately 1900 turns per yard.

In one or more implementations, the cover layer includes flexible threads braided around the conductive core. Any type of flexible thread 308 may be used for the braided cover layer. The thickness of the flexible thread and the number of flexible threads that are braided around the conductive core can be selected based on the desired thickness of conductive yarn 208. For example, if conductive yarn 208 is intended to be used for denim, a thicker flexible thread (e.g., cotton) and/or a greater number of flexible threads may be used to form the cover layer.

In one embodiment, the cover layer 252 is made from preshrunk threads, such as preshrunk polyester threads. The preshrunk threads, for instance, can have a size of less than about 100 denier, such as less than about 80 denier, such as less than about 70 denier, such as less than about 60 denier, such as less than about 55 denier. The threads can have a size of greater than about 20 denier, such as greater than about 30 denier, such as greater than about 35 denier, such as greater than about 40 denier, such as greater than about 45 denier.

As described above, the conductive yarn 208 can be constructed as described above and have a size that substantially matches the non-conductive threads or yarns that are used to make the textile product. For example, in one embodiment, the conductive yarn 208 can include from about 8 to about 15 conductive filaments 254 within the conductive core 250 and can have a braided outer cover layer and still have a size that substantially matches a cotton spun yarn. For instance, the conductive yarn 208 can have a size (i.e. diameter) that substantially matches a 5/1 cotton spun yarn. It should be understood, however, that the conductive yarn can be used to match any suitable yarn in diameter. For instance, the conductive yarn can have a diameter similar to a cotton yarn having a size anywhere from 2/1 to about 50/1, such as from about 3/1 to about 20/1.

Interactive textile 102 can be formed cheaply and efficiently, using any conventional weaving or knitting process (e.g., jacquard weaving or 3D-weaving), which, in weaving operations, involves interlacing a set of longer threads (called the warp) with a set of crossing threads (called the weft). Weaving may be implemented on a frame or machine known as a loom, of which there are a number of types. Thus, a loom can weave non-conductive threads 302 with conductive yarns 208 to create interactive textile 102.

In example 300, conductive yarn 208 is woven into interactive textile 102 to form a grid that includes a set of substantially parallel conductive yarns 208 and a second set of substantially parallel conductive yarns 208 that crosses the first set of conductive yarns to form the grid. In this example, the first set of conductive yarns 208 are oriented horizontally and the second set of conductive yarns 208 are oriented vertically, such that the first set of conductive yarns 208 are positioned substantially orthogonal to the second set of conductive yarns 208. It is to be appreciated, however, that conductive yarns 208 may be oriented such that crossing conductive yarns 208 are not orthogonal to each other. For example, in some cases crossing conductive yarns 208 may form a diamond-shaped grid. While conductive yarns 208 are illustrated as being spaced out from each other in FIG. 3, it is to be noted that conductive yarns 208 may be weaved very closely together. For example, in some cases two or three conductive yarns may be weaved closely together in each direction.

In FIG. 3, the conductive yarns 208 form a grid. It should be understood, however, that the conductive yarns made in accordance with the present disclosure can be woven or knitted into any suitable fabric structure using any suitable pattern capable of carrying out the processes of the present disclosure. The conductive yarns, for instance, can be strategically placed within the fabric at any desired location in order to form a countless variety of different electrical circuits or capacitive touch-pads for use in carrying out the processes of the present disclosure.

Figure 7:
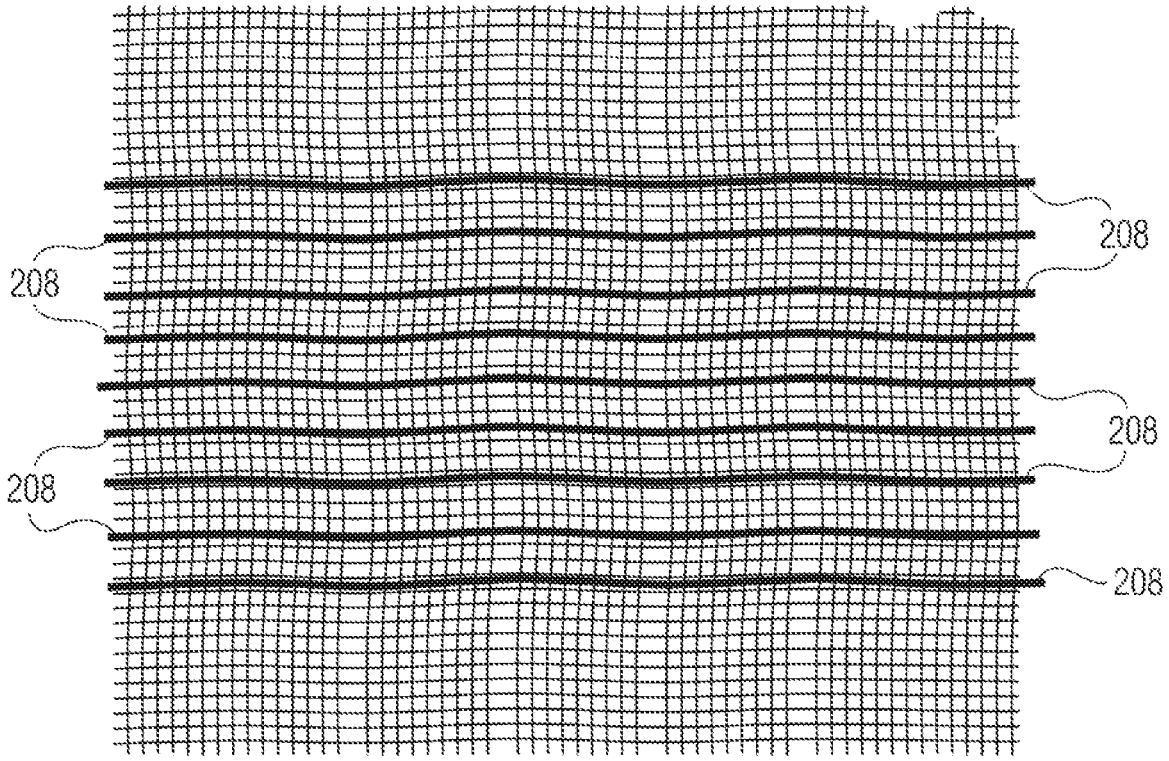
FIG. 7 illustrates an example of an interactive textile with a single textile layer in accordance with one or more implementations.

For instance, in Example 400 shown in FIG. 7, the conductive yarns 208 are contained within the textile product as a plurality of parallel yarns only and do not form a grid. In other embodiments, however, other more complicated weaving patterns of the conductive yarns 208 can be used.

Figure 8:
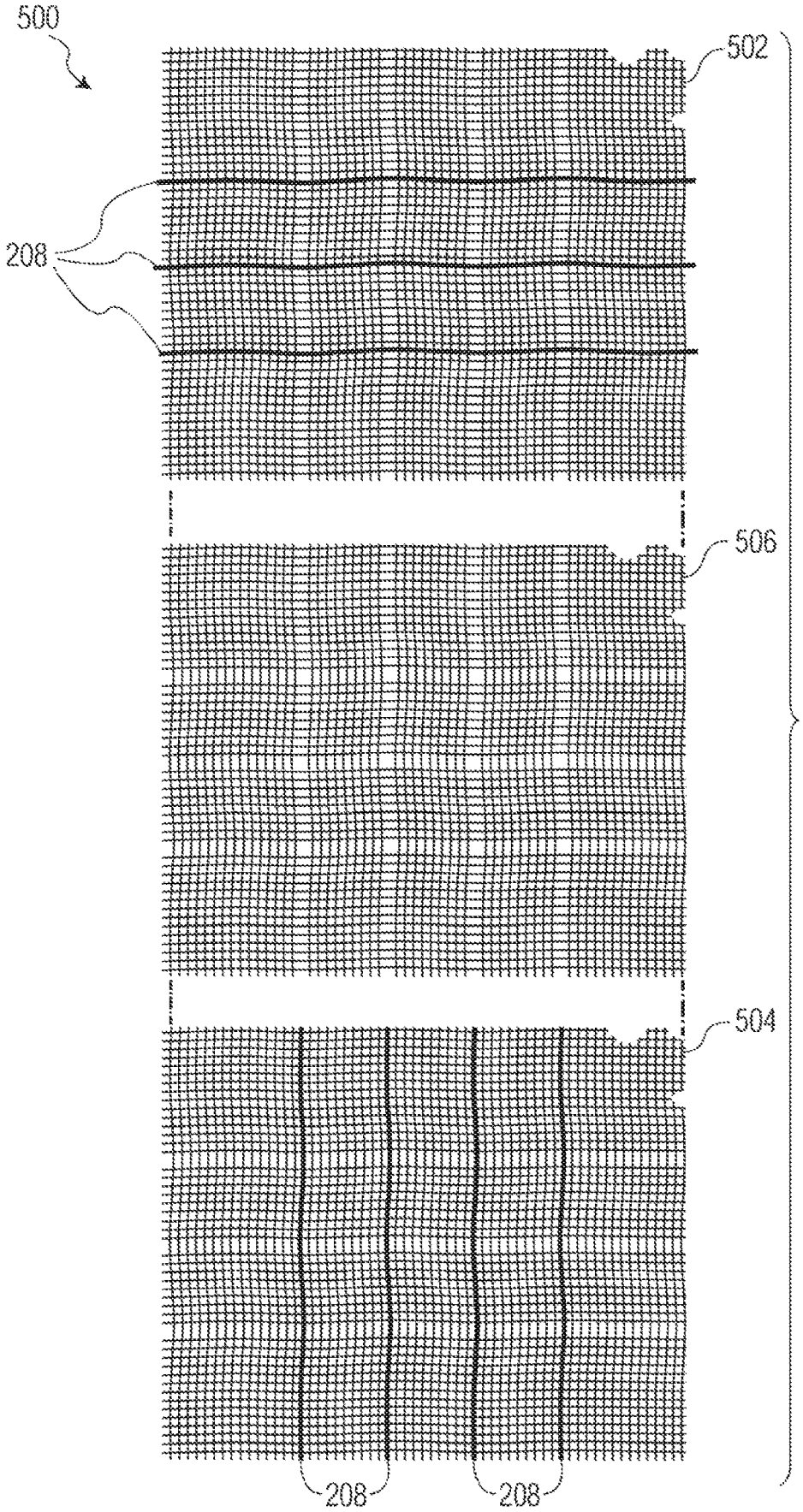
FIG. 8 illustrates an example of an interactive textile with multiple textile layers in accordance with one or more implementations.

Consider, for example, FIG. 8 which illustrates an example 500 of an interactive textile 102 with multiple textile layers. In example 500, interactive textile 102 includes a first textile layer 502, a second textile layer 504, and a third textile layer 506. The three textile layers may be combined (e.g., by sewing or gluing the layers together) to form interactive textile 102. In this example, first textile layer 502 includes horizontal conductive yarns 208, and second textile layer 504 includes vertical conductive yarns 208. Third textile layer 506 does not include any conductive yarns, and is positioned between first textile layer 502 and second textile layer 504 to prevent vertical conductive yarns from making direct contact with horizontal conductive yarns 208.

In one or more implementations, interactive textile 102 includes a top textile layer and a bottom textile layer. The top textile layer includes conductive yarns 208 woven into the top textile layer, and the bottom textile layer also includes conductive yarns woven into the bottom textile layer. When the top textile layer is combined with the bottom textile layer, the conductive yarns from each layer form capacitive touch sensor 202.

Figure 9:
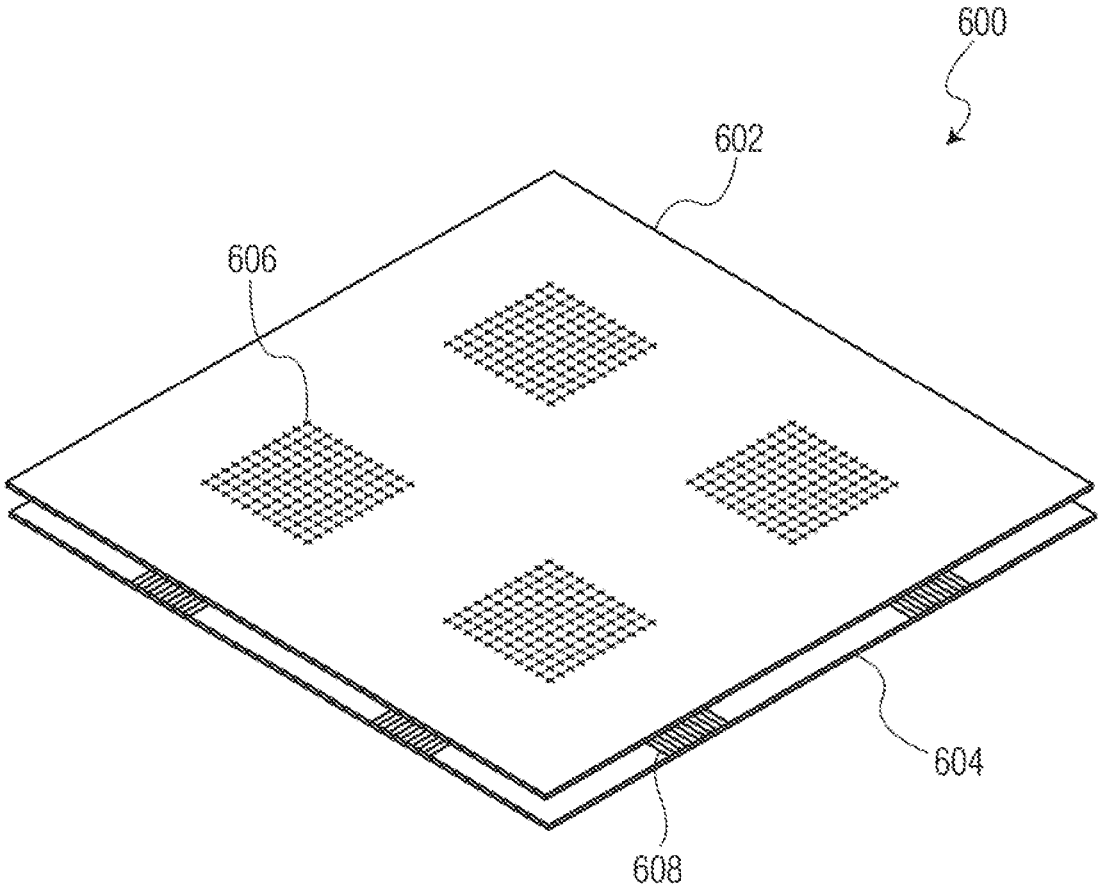
FIG. 9 illustrates an example of multiple textile layers of a two-layer interactive textile in accordance with one or more implementations.

Consider for example, FIG. 9 which illustrates an example 600 of a two-layer interactive textile 102 in accordance with one or more implementations. In this example, interactive textile 102 includes a first textile layer 602 and a second textile layer 604. First textile layer 602 is considered the "top textile layer" and includes first conductive yarns 606 woven into first textile layer 602. Second textile layer 604 is considered the "bottom textile layer" of interactive textile 102 and includes second conductive yarns 608 woven into second textile layer 604. When integrated into flexible object 104, such as a clothing item, first textile layer 602 is visible and faces the user such that the user is able to interact with first textile layer 602, while second textile layer 604 is not visible. For instance, first textile layer 602 may be part of an "outside surface" of the clothing item, while second textile layer may be the "inside surface" of the clothing item.

When first textile layer 602 and second textile layer 604 are combined, first conductive yarns 606 of first textile layer 602 couples to second conductive yarns 608 of second textile layer 604 to form capacitive touch sensor 202, as described above. In one or more implementations, the direction of the conductive yarns changes from first textile layer 602 to second textile layer 604 to form a grid of conductive yarns, as described above. For example, first conductive yarns 606 in first textile layer 602 may be positioned substantially orthogonal to second conductive yarns 608 in second textile layer 604 to form the grid of conductive yarns.

In some cases, first conductive yarns 606 may be oriented substantially horizontally and second conductive yarns 608 may be oriented substantially vertically. Alternately, first conductive yarns 606 may be oriented substantially vertically and second conductive yarns 608 may be oriented substantially horizontally. Alternately, first conductive yarns 606 may be oriented such that crossing conductive yarns 608 are not orthogonal to each other. For example, in some cases crossing conductive yarns 606 and 608 may form a diamond-shaped grid.

First textile layer 602 and second textile layer 604 can be formed independently, or at different times. For example, a manufacturer may weave second conductive yarns 608 into second textile layer 604. A designer could then purchase second textile layer 604 with the conductive yarns already woven into the second textile layer 604, and create first textile layer 602 by weaving conductive yarn into a textile design. First textile layer 602 can then be combined with second textile layer 604 to form interactive textile 102.

First textile layer and second textile layer may be combined in a variety of different ways, such as by weaving, sewing, or gluing the layers together to form interactive textile 102. In one or more implementations, first textile layer 602 and second textile layer 604 are combined using a jacquard weaving process or any type of 3D-weaving process. When first textile layer 602 and second textile layer 604 are combined, the first conductive yarns 606 of first textile layer 602 couple to second conductive yarns 608 of second textile layer 604 to form capacitive touch sensor 202, as described above.

During operation, capacitive touch sensor 202 may be configured to determine positions of touch-input on the grid of conductive yarn 208 using self-capacitance sensing or projective capacitive sensing. In other embodiments, however, the location of the touch-input on the plurality of conductive yarns 208 may not be necessary, such as when using the embodiment illustrated in FIG. 7.

When configured as a self-capacitance sensor, textile controller 204 charges crossing conductive yarns 208 (e.g., horizontal and vertical conductive yarns) by applying a control signal (e.g., a sine signal) to each conductive yarn 208. When an object, such as the user's finger, touches the grid of conductive yarn 208, the conductive yarns 208 that are touched are grounded, which changes the capacitance (e.g., increases or decreases the capacitance) on the touched conductive yarns 208.

Textile controller 204 uses the change in capacitance to identify the presence of the object. To do so, textile controller 204 detects a position of the touch-input by detecting which horizontal conductive yarn 208 is touched, and which vertical conductive yarn 208 is touched by detecting changes in capacitance of each respective conductive yarn 208. Textile controller 204 uses the intersection of the crossing conductive yarns 208 that are touched to determine the position of the touch-input on capacitive touch sensor 202. For example, textile controller 204 can determine touch data by determining the position of each touch as X,Y coordinates on the grid of conductive yarn 208.

When implemented as a self-capacitance sensor, "ghosting" may occur when multi-touch input is received. Consider, for example, that a user touches the grid of conductive yarn 208 with two fingers. When this occurs, textile controller 204 determines X and Y coordinates for each of the two touches. However, textile controller 204 may be unable to determine how to match each X coordinate to its corresponding Y coordinate. For example, if a first touch has the coordinates X1, Y1 and a second touch has the coordinates X4,Y4, textile controller 204 may also detect "ghost" coordinates X1, Y4 and X4,Y1.

In one or more implementations, textile controller 204 is configured to detect "areas" of touch-input corresponding to two or more touch-input points on the grid of conductive yarn 208. Conductive yarns 208 may be weaved closely together such that when an object touches the grid of conductive yarn 208, the capacitance will be changed for multiple horizontal conductive yarns 208 and/or multiple vertical conductive yarns 208. For example, a single touch with a single finger may generate the coordinates X1,Y1 and X2,Y1. Thus, textile controller 204 may be configured to detect touch-input if the capacitance is changed for multiple horizontal conductive yarns 208 and/or multiple vertical conductive yarns 208. Note that this removes the effect of ghosting because textile controller 204 will not detect touch-input if two single-point touches are detected which are spaced apart.

Alternately, when implemented as a projective capacitance sensor, textile controller 204 charges a single set of conductive yarns 208 (e.g., horizontal conductive yarns 208) by applying a control signal (e.g., a sine signal) to the single set of conductive yarns 208. Then, textile controller 204 senses changes in capacitance in the other set of conductive yarns 208 (e.g., vertical conductive yarns 208).

In this implementation, vertical conductive yarns 208 are not charged and thus act as a virtual ground. However, when horizontal conductive yarns 208 are charged, the horizontal conductive yarns capacitively couple to vertical conductive yarns 208. Thus, when an object, such as the user's finger, touches the grid of conductive yarn 208, the capacitance changes on the vertical conductive yarns (e.g., increases or decreases). Textile controller 204 uses the change in capacitance on vertical conductive yarns 208 to identify the presence of the object. To do so, textile controller 204 detects a position of the touch-input by scanning vertical conductive yarns 208 to detect changes in capacitance. Textile controller 204 determines the position of the touch-input as the intersection point between the vertical conductive yarn 208 with the changed capacitance, and the horizontal conductive yarn 208 on which the control signal was transmitted. For example, textile controller 204 can determine touch data by determining the position of each touch as X,Y coordinates on the grid of conductive yarn 208.

Whether implemented as a self-capacitance sensor or a projective capacitance sensor, capacitive sensor 208 is configured to communicate the touch data to gesture manager 218 to enable gesture manager 218 to determine gestures based on the touch data, which can be used to control object 104, computing device 106, or applications 216 at computing device 106.

Gesture manager 218 can be implemented to recognize a variety of different types of gestures, such as touches, taps, swipes, holds, and covers made to interactive textile 102. To recognize the various different types of gestures, gesture manager 218 is configured to determine a duration of the touch, swipe, or hold (e.g., one second or two seconds), a number of the touches, swipes, or holds (e.g., a single tap, a double tap, or a triple tap), a number of fingers of the touch, swipe, or hold (e.g., a one finger-touch or swipe, a two-finger touch or swipe, or a three-finger touch or swipe), a frequency of the touch, and a dynamic direction of a touch or swipe (e.g., up, down, left, right). With regards to holds, gesture manager 218 can also determine an area of capacitive touch sensor 202 of interactive textile 102 that is being held (e.g., top, bottom, left, right, or top and bottom. Thus, gesture manager 218 can recognize a variety of different types of holds, such as a cover, a cover and hold, a five finger hold, a five finger cover and hold, a three finger pinch and hold, and so forth.

Figure 10A:
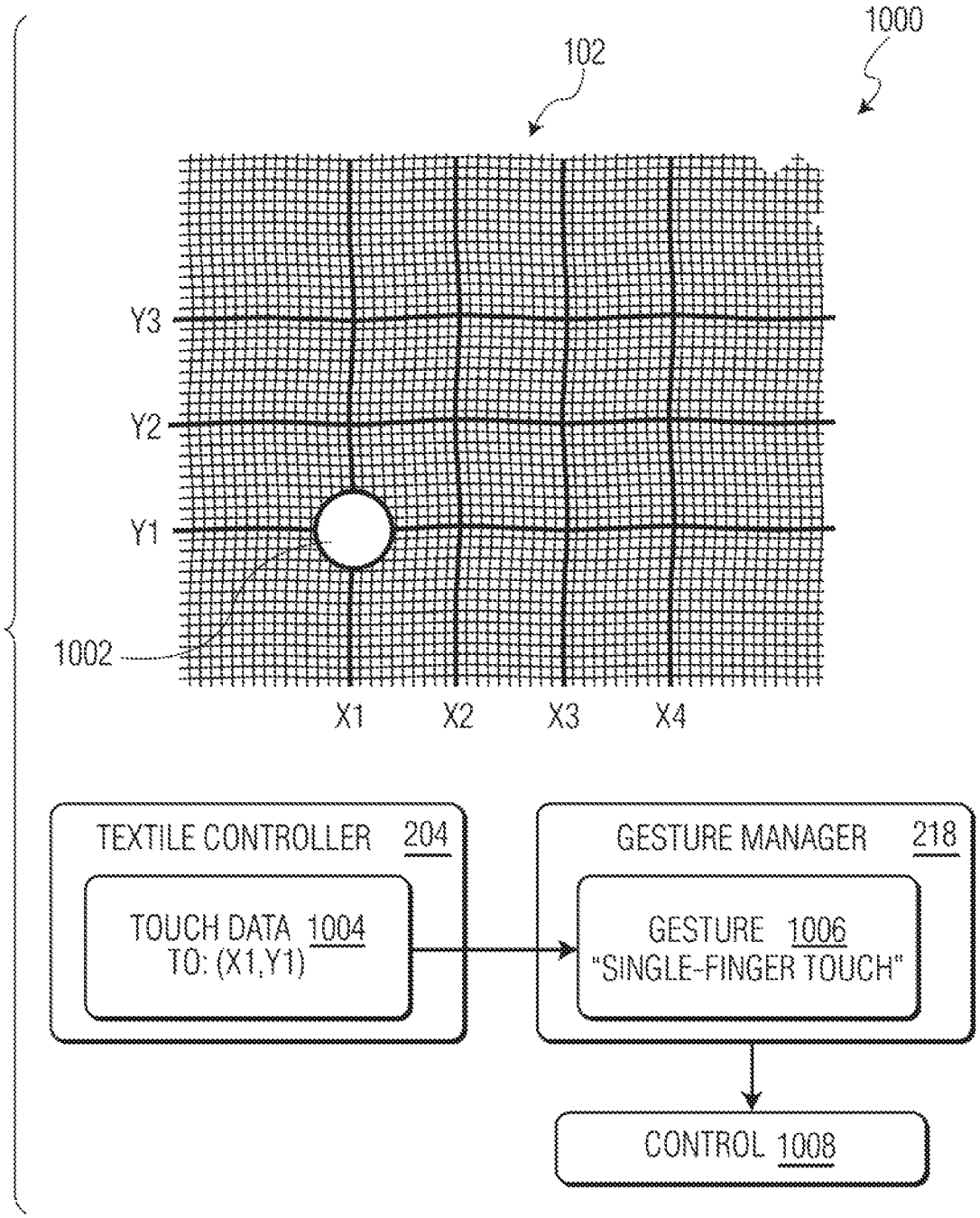
FIG. 10A illustrates an example of generating a control based on touch-input corresponding to a single-finger touch.

FIG. 10A illustrates an example 1000 of generating a control based on touch-input corresponding to a single-finger touch. In example 1000, horizontal conductive yarns 208 and vertical conductive yarns 208 of capacitive touch sensor 202 form an X,Y grid. The X-axis in this grid is labeled X1, X2, X3, and X4, and the Y-axis is labeled Y1, Y2, and Y3. As described above, textile controller 204 can determine the location of each touch on this X,Y grid using self-capacitance sensing or projective capacitance sensing.

In this example, touch-input 1002 is received when a user touches interactive textile 102. When touch-input 1002 is received, textile controller 204 determines the position and time of touch-input 1002 on the grid of conductive yarn 208, and generates touch data 1004 which includes the position of the touch: "X1,Y1", and a time of the touch: T0. Then, touch data 1004 is communicated to gesture manager 218 at computing device 106 (e.g., over network 108 via network interface 210).

Gesture manager 218 receives touch data 1004, and generates a gesture 1006 corresponding to touch data 1004. In this example, gesture manager 218 determines gesture 1006 to be "single-finger touch" because the touch data corresponds to a single touch-input point (X1,Y1) at a single time period (T0). Gesture manager 218 may then initiate a control 1008 to activate a functionality of computing device 106 based on the single-finger touch gesture 1006 to control object 104, computing device 106, or an application 216 at computing device 106. A single-finger touch gesture, for example, may be used to control computing device 106 to power-on or power-off, to control an application 216 to open or close, to control lights in the user's house to turn on or off, and so on.

Figure 10B:
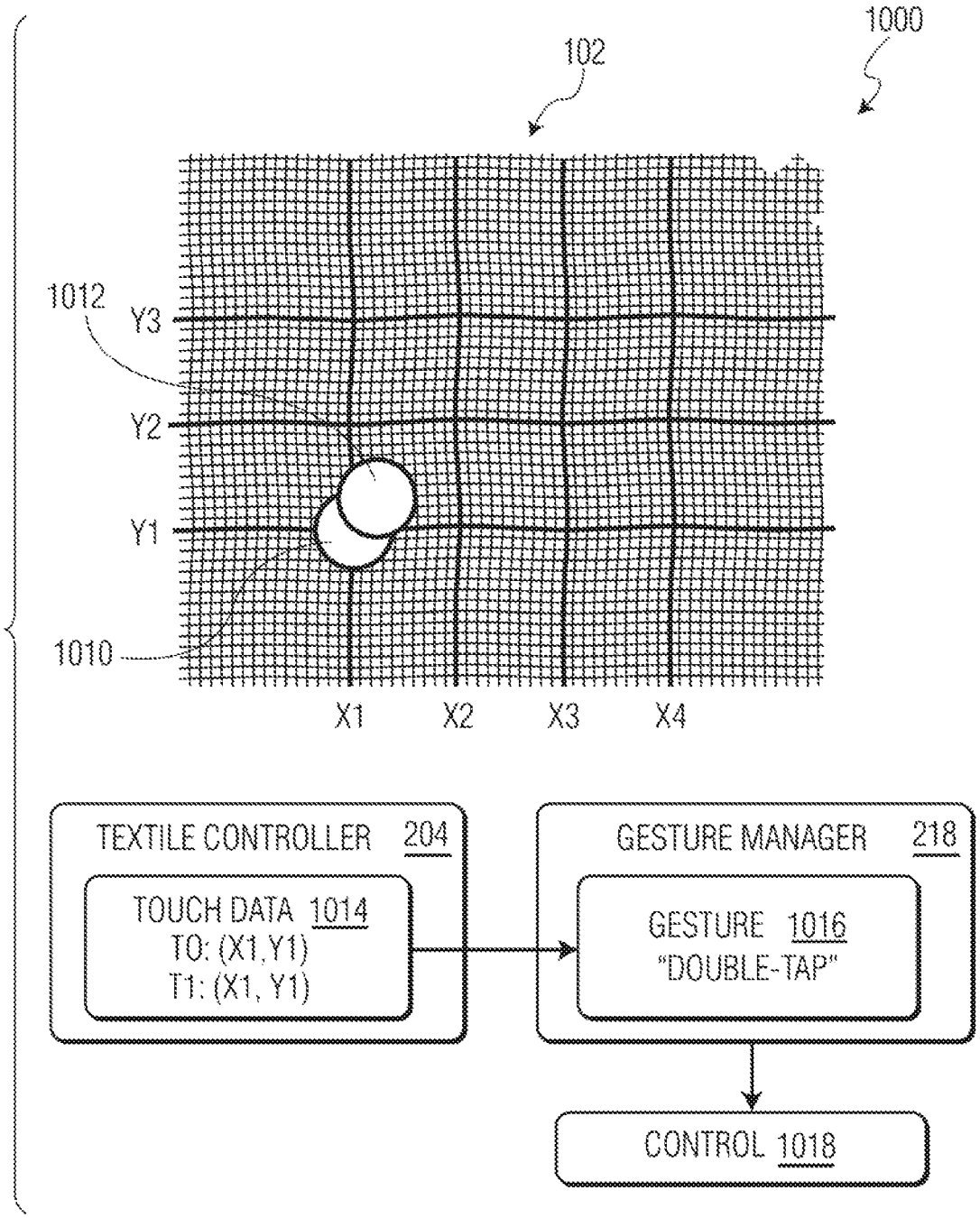
FIG. 10B illustrates an example of generating a control based on touch-input corresponding to a double-tap.

FIG. 10B illustrates an example 1000 of generating a control based on touch-input corresponding to a double-tap. In this example, touch-input 1010 and 1012 is received when a user double taps interactive textile 102, such as by quickly tapping interactive textile 102. When touch-input 1010 and 1012 is received, textile controller 204 determines the positions and time of the touch-input on the grid of conductive yarn 208, and generates touch data 1014 which includes the position of the first touch: "X1,Y1", and a time of the first touch: T0. The touch data 1014 further includes the position of the second touch: "X1,Y1", and the time of the second touch: T1. Then, touch data 1014 is communicated to gesture manager 218 at computing device 106 (e.g., over network 108 via network interface 210).

Gesture manager 218 receives touch data 1014, and generates a gesture 1016 corresponding to the touch data. In this example, gesture manager 218 determines gesture 1016 as a "double-tap" based on two touches being received at substantially the same position at different times. Gesture manager 218 may then initiate a control 1018 to activate a functionality of computing device 106 based on the double-tap touch gesture 1016 to control object 104, computing device 106, or an application 216 at computing device 106. A double-tap gesture, for example, may be used to control computing device 106 to power-on an integrated camera, start the play of music via a music application 216, lock the user's house, and so on.

Figure 10C:
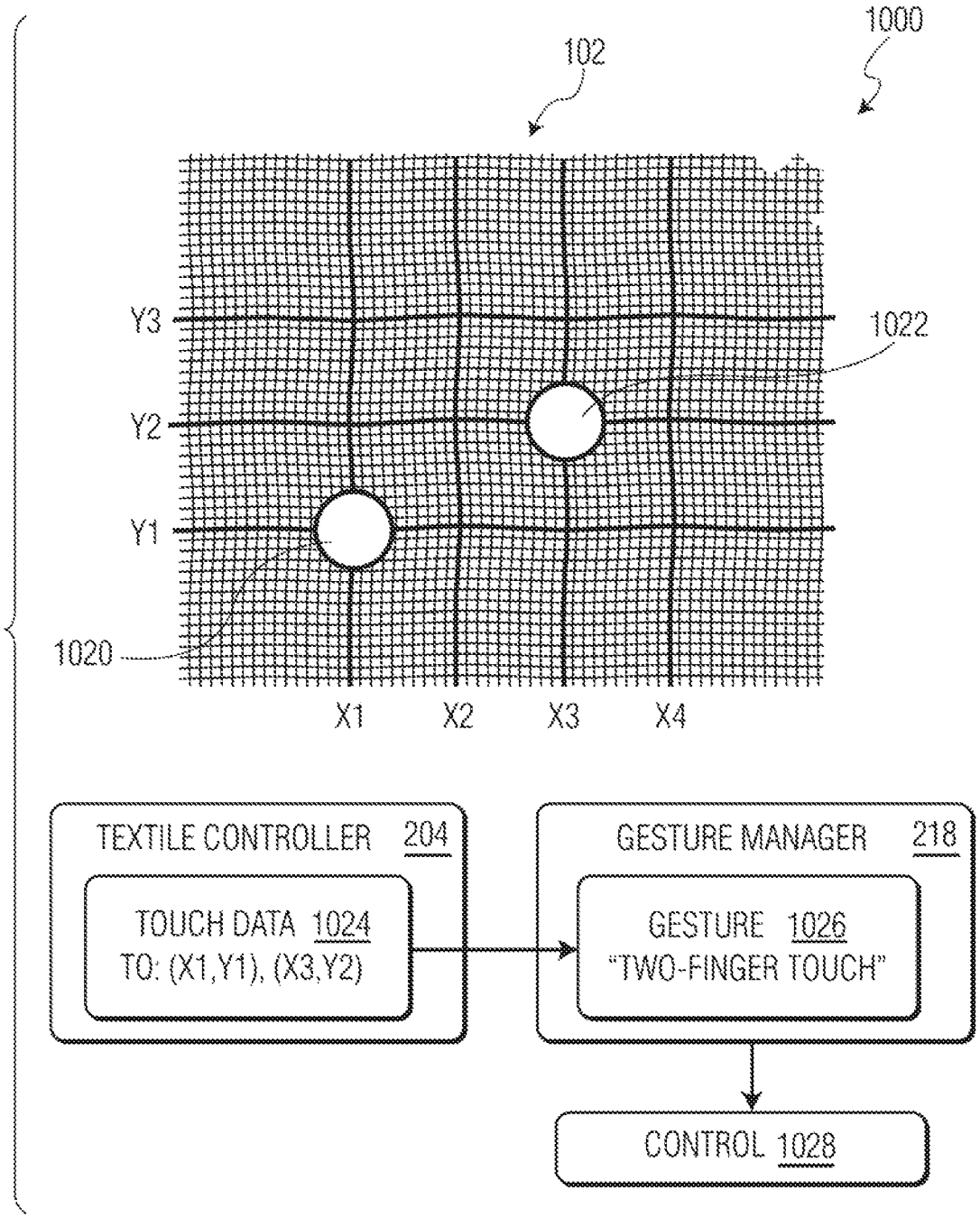
FIG. 10C illustrates an example of generating a control based on touch-input corresponding to a two-finger touch.

FIG. 10C illustrates an example 1000 of generating a control based on touch-input corresponding to a two-finger touch. In this example, touch-input 1020 and 1022 is received when a user touches interactive textile 102 with two fingers at substantially the same time. When touch-input 1020 and 1022 is received, textile controller 204 determines the positions and time of the touch-input on the grid of conductive yarn 208, and generates touch data 1024 which includes the position of the touch by a first finger: "X1,Y1", at a time T0. Touch data 1024 further includes the position of the touch by a second finger: "X3,Y2", at the same time T0. Then, touch data 1024 is communicated to gesture manager 218 at computing device 106 (e.g., over network 108 via network interface 210).

Gesture manager 218 receives touch data 1024, and generates a gesture 1026 corresponding to the touch data. In this case, gesture manager 218 determines gesture 1026 as a "two-finger touch" based on two touches being received in different positions at substantially the same time. Gesture manager may then initiate a control 1028 to activate a functionality of computing device 106 based on two-finger touch gesture 1026 to control object 104, computing device 106, or an application 216 at computing device 106. A two-finger touch gesture, for example, may be used to control computing device 106 to take a photo using an integrated camera, pause the playback of music via a music application 216, turn on the security system at the user's house and so on.

Figure 10D:
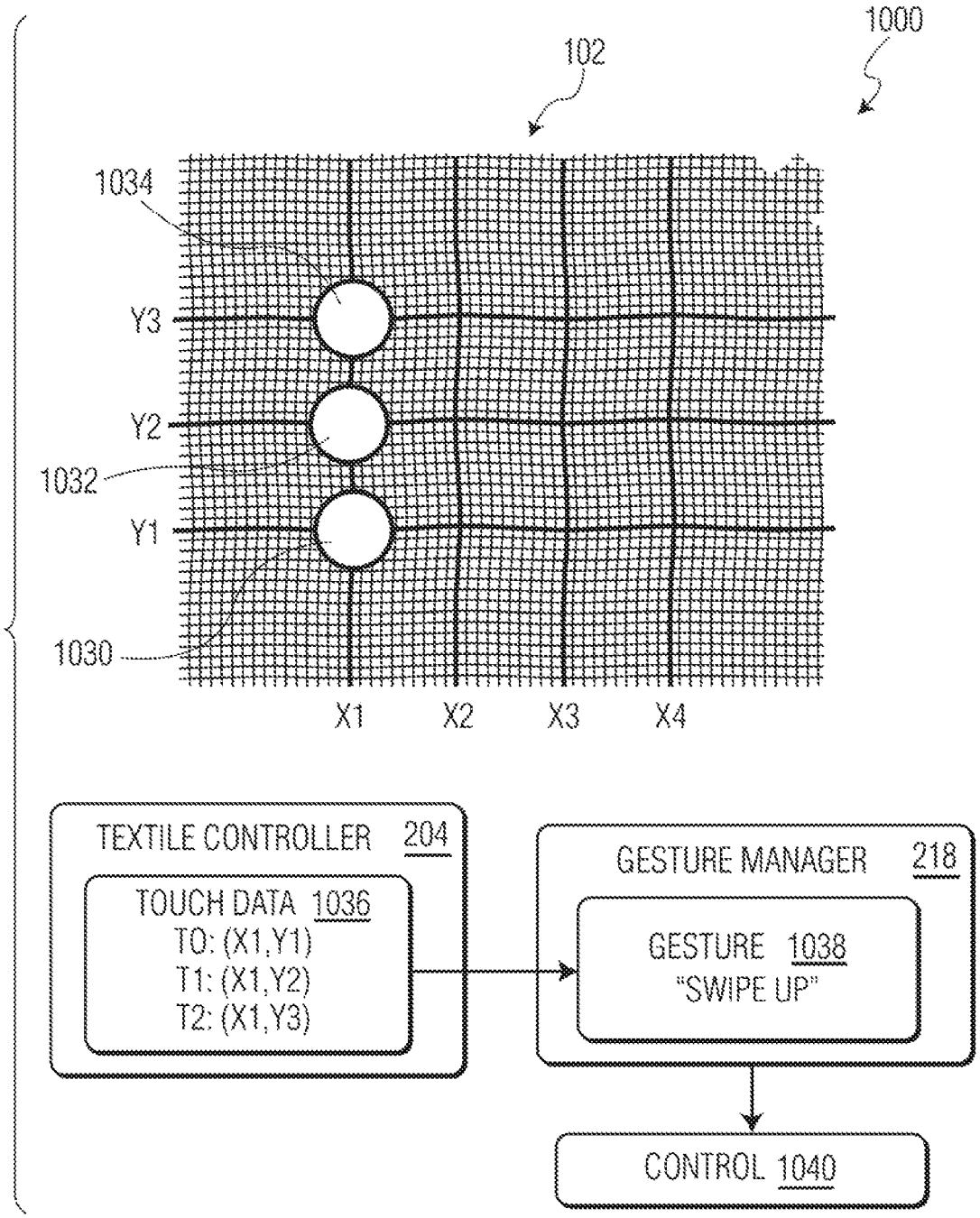
FIG. 10D illustrates an example of generating a control based on touch-input corresponding to a swipe up.

FIG. 10D which illustrates an example 1000 of generating a control based on touch-input corresponding to a single-finger swipe up. In this example, touch-input 1030, 1032, and 1034 is received when a user swipes upwards on interactive textile 102 using a single finger. When touch-input 1030, 1032, and 1034 is received, textile controller 204 determines the positions and time of the touch-input on the grid of conductive yarn 208, and generates touch data 1036 corresponding to the position of a first touch as "X1,Y1" at a time T0, a position of a second touch as "X1,Y2" at a time T1, and a position of a third touch as "X1,Y3" at a time T2. Then, touch data 1036 is communicated to gesture manager 218 at computing device 106 (e.g., over network 108 via network interface 210).

Gesture manager 218 receives touch data 1036, and generates a gesture 1038 corresponding to the touch data. In this case, the gesture manager 218 determines gesture 1038 as a "swipe up" based on three touches being received in positions moving upwards on the grid of conductive yarn 208. Gesture manager may then initiate a control 1040 to activate a functionality of computing device 106 based on the swipe up gesture 1038 to control object 104, computing device 106, or an application 216 at computing device 106. A swipe up gesture, for example, may be used to control computing device 106 to accept a phone call, increase the volume of music being played by a music application 216, or turn on lights in the user's house.

While examples above describe, generally, various types of touch-input gestures that are recognizable by interactive textile 102, it is to be noted that virtually any type of touch-input gestures may be detected by interactive textile 102. For example, any type of single or multi-touch taps, touches, holds, swipes, and so forth, that can be detected by conventional touch-enabled smart phones and tablet devices, may also be detected by interactive textile 102.

In one or more implementations, gesture manager 218 enables the user to create gestures and assign the gestures to functionality of computing device 106. The created gestures may include taps, touches, swipes and holds as described above. In addition, gesture manager 218 can recognize gesture strokes, such as gesture strokes corresponding to symbols, letters, numbers, and so forth.

Figure 11:
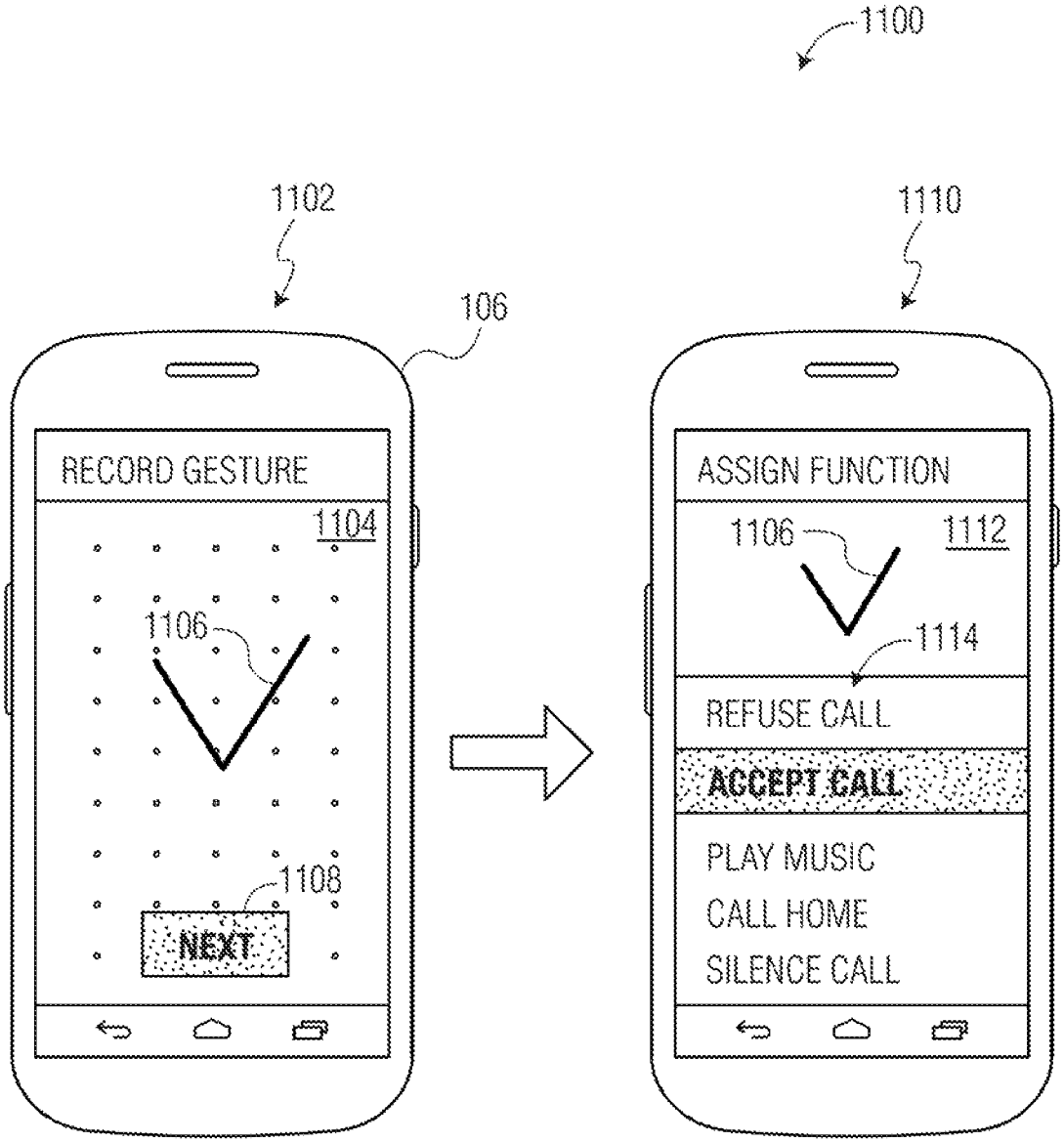
FIG. 11 illustrates an example of creating and assigning gestures to functionality of a computing device in accordance with one or more implementations.

Consider, for example, FIG. 11 which illustrates an example 1100 of creating and assigning gestures to functionality of computing device 106 in accordance with one or more implementations.

In this example, at a first stage 1102, gesture manager 218 causes display of a record gesture user interface 1104 on a display of computing device 106 during a gesture mapping mode. The gesture mapping mode may be initiated by gesture manager 218 automatically when interactive textile 102 is paired with computing device 106, or responsive to a control or command initiated by the user to create and assign gestures to functionalities of computing device 106.

In the gesture mapping mode, gesture manager 218 prompts the user to input a gesture to interactive textile 102. Textile controller 204, at interactive textile 102, monitors for gesture input to interactive textile 102 woven into an item of clothing (e.g., a jacket) worn by the user, and generates touch data based on the gesture. The touch data is then communicated to gesture manager 218.

In response to receiving the touch data from interactive textile 102, gesture manager 218 analyzes the touch data to identify the gesture. Gesture manager 218 may then cause display of a visual representation 1106 of the gesture on display 220 of computing device 106. In this example, visual representation 1106 of the gesture is a "v" which corresponds to the gesture that is input to interactive textile 102. Gesture user interface includes a next control 1108 which enables the user to transition to a second stage 1110.

At second stage 1110, gesture manager 218 enables the user to assign the gesture created at first stage 1102 to a functionality of computing device 106. As described herein, a "functionality" of computing device 106 can include any command, control, or action at computing device 102. Examples of functionalities of computing device 106 may include, by way of example and not limitation, answering a call, music playing controls (e.g., next song, previous song, pause, and play), requesting the current weather, and so forth.

In this example, gesture manager 218 causes display of an assign function user interface 1112 which enables the user to assign the gesture created at first stage 1102 to one or more functionalities of computing device 102. Assign function user interface 1112 includes a list 1114 of functionalities that are selectable by the user to assign or map the gesture to the selected functionality. In this example, list 1114 of functionalities includes "refuse call", "accept call", "play music", "call home", and "silence call".

Gesture manager receives user input to assign function user interface 1112 to assign the gesture to a functionality, and assigns the gesture to the selected functionality. In this example, the user selects the "accept call" functionality, and gesture manager 218 assigns the "v" gesture created at first stage 1102 to the accept call functionality.

Assigning the created gesture to the functionality of computing device 106 enables the user to initiate the functionality, at a subsequent time, by inputting the gesture into interactive textile 102. In this example, the user can now make the "v" gesture on interactive textile 102 in order to cause computing device 106 to accept a call to computing device 106.

Gesture manager 218 is configured to maintain mappings between created gestures and functionalities of computing device 106 in a gesture library. The mappings can be created by the user, as described above. Alternately or additionally, the gesture library can include predefined mappings between gestures and functionalities of computing device 106.

Figure 12:
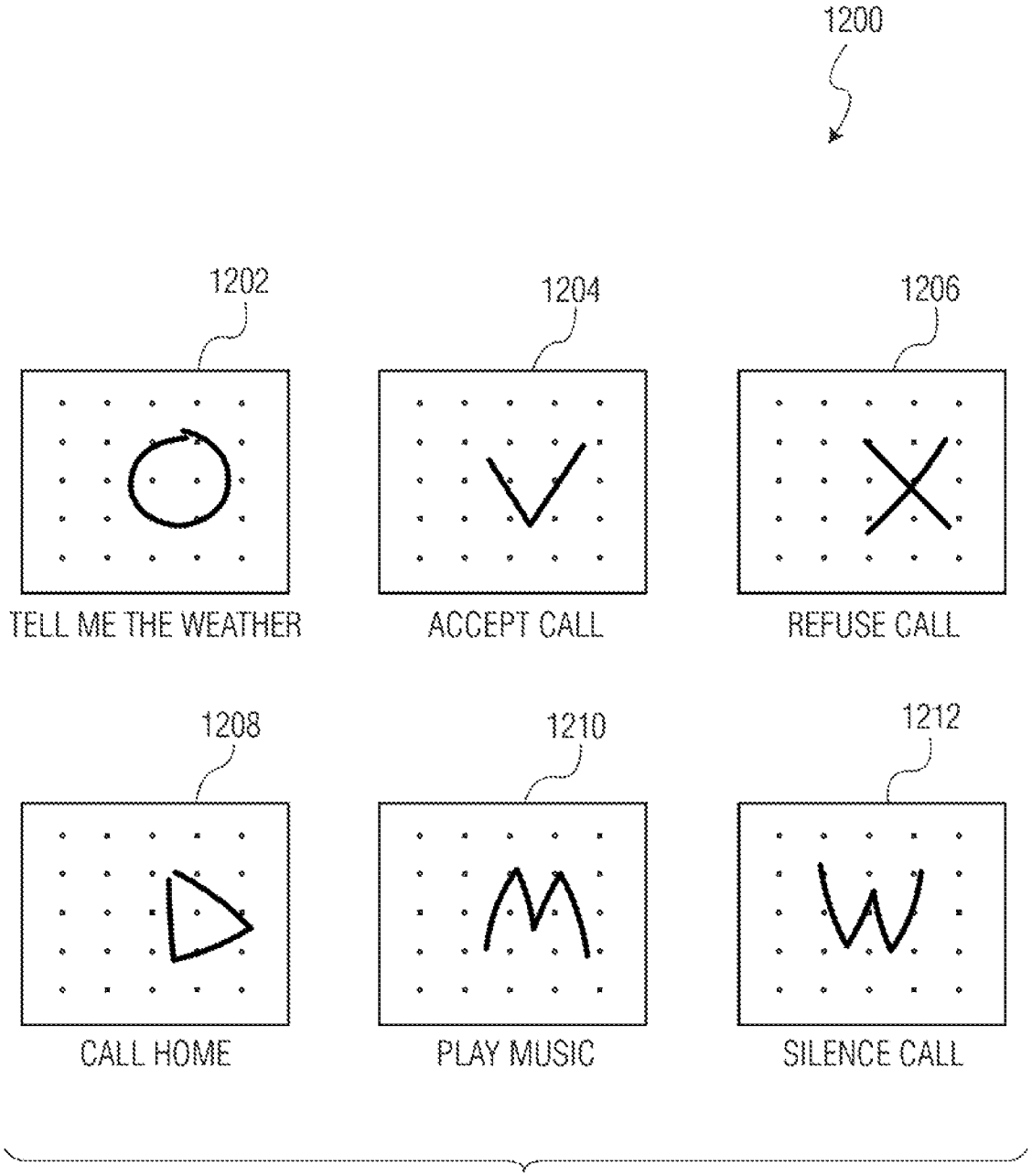
FIG. 12 illustrates an example of a gesture library in accordance with one or more implementations.

As an example, consider FIG. 12 which illustrates an example 1200 of a gesture library in accordance with one or more implementations. In example 1200, the gesture library includes multiple different mappings between gestures and device functionalities of computing device 106. At 1202, a "circle" gesture is mapped to a "tell me the weather" function, at 1204 a "v" gesture is mapped to an accept call function, at 1206 an "x" gesture is mapped to a "refuse call" function, at 1208 a "triangle" gesture is mapped to a "call home" function, at 1210 an "m" gesture is mapped to a "play music" function, and at 1212 a "w" gesture is mapped to a "silence call" function.

As noted above, the mappings at 1202, 1204, 1206, 1208, 1210, and 1212 may be created by the user or may be predefined such that the user does not need to first create and assign the gesture. Further, the user may be able to change or modify the mappings by selecting the mapping and creating a new gesture to replace the currently assigned gesture.

Notably, there may be a variety of different functionalities that the user may wish to initiate via a gesture to interactive textile 102. However, there is a limited number of different gestures that a user can realistically be expected to remember. Thus, in one or more implementations gesture manager 218 is configured to select a functionality based on both a gesture to interactive textile 102 and a context of computing device 106. The ability to recognize gestures based on context enables the user to invoke a variety of different functionalities using a subset of gestures. For example, for a first context, a first gesture may initiate a first functionality, whereas for a second context, the same first gesture may initiate a second functionality.

In some cases, the context of computing device 106 may be based on an application that is currently running on computing device 106. For example, the context may correspond to listening to music when the user is utilizing a music player application to listen to music, and to "receiving a call" when a call is communicated to computing device 106. In these cases, gesture manager 218 can determine the context by determining the application that is currently running on computing device 106.

Alternately or additionally, the context may correspond to an activity that the user is currently engaged in, such as running, working out, driving a car, and so forth. In these cases, gesture manager 218 can determine the context based on sensor data received from sensors implemented at computing device 106, interactive textile 102, or another device that is communicably coupled to computing device 106. For example, acceleration data from an accelerometer may indicate that the user is currently running, driving in a car, riding a bike, and so forth. Other non-limiting examples of determining context include determining the context based on calendar data (e.g., determining the user is in a meeting based on the user's calendar), determining context based on location data, and so forth.

After the context is determined, textile controller 204, at interactive textile 102, monitors for gesture input to interactive textile 102 woven into an item of clothing (e.g., a jacket) worn by the user, and generates touch data based on the gesture input. The touch data is then communicated to gesture manager 218.

In response to receiving the touch data from interactive textile 102, gesture manager 218 analyzes the touch data to identify the gesture. Then, gesture manager 218 initiates a functionality of computing device based on the gesture and the context. For example, gesture manager 218 can compare the gesture to a mapping that assigns gestures to different contexts. A given gesture, for example, may be associated with multiple different contexts and associated functionalities. Thus, when a first gesture is received, gesture manager 218 may initiate a first functionality if a first context is detected, or initiate a second, different functionality if a second, different context is detected.

Figure 13:
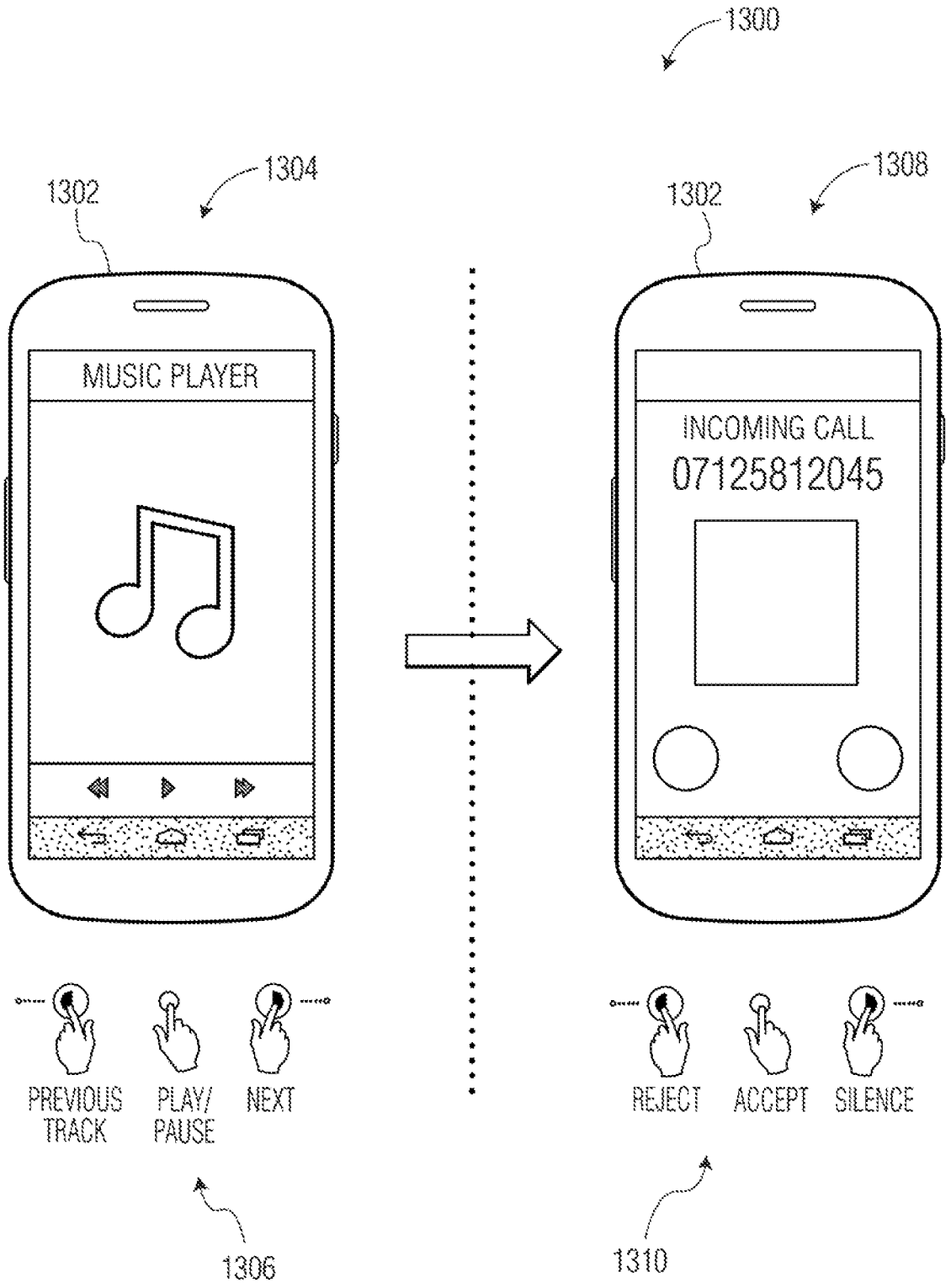
FIG. 13 illustrates an example of contextual-based gestures to an interactive textile in accordance with one or more implementations.

As an example, consider FIG. 13 which illustrates an example 1300 of contextual-based gestures to an interactive textile in accordance with one or more implementations.

In this example, computing device 106 is implemented as a smart phone 1302 that is communicably coupled to interactive textile 102. For example, interactive textile 102 may be woven into a jacket worn by the user, and coupled to smart phone 1302 via a wireless connection such as Bluetooth.

At 1304, smart phone 1302 is in a "music playing" context because a music player application is playing music on smart phone 1302. In the music playing context, gesture manager 218 has assigned a first subset of functionalities to a first subset of gestures at 1306. For example, the user can play a previous song by swiping left on interactive textile 102, play or pause a current song by tapping interactive textile 102, or play a next song by swiping right on interactive textile 102.

At 1308, the context of smart phone 1302 changes to an "incoming call" context when smart phone 1302 receives an incoming call. In the incoming call context, the same subset of gestures is assigned to a second subset of functionalities which are associated with the incoming call context at 1310. For example, by swiping left on interactive textile 102 the user can now reject the call, whereas before swiping left would have caused the previous song to be played in the music playing context. Similarly, by tapping interactive textile 102 the user can accept the call, and by swiping right on interactive textile 102 the user can silence the call.

In one or more implementations, interactive textile 102 further includes one or more output devices, such as one or more light sources (e.g., LED's), displays, speakers, and so forth. These output devices can be configured to provide feedback to the user based on touch-input to interactive textile 102 and/or notifications based on control signals received from computing device 106.

Figure 14:
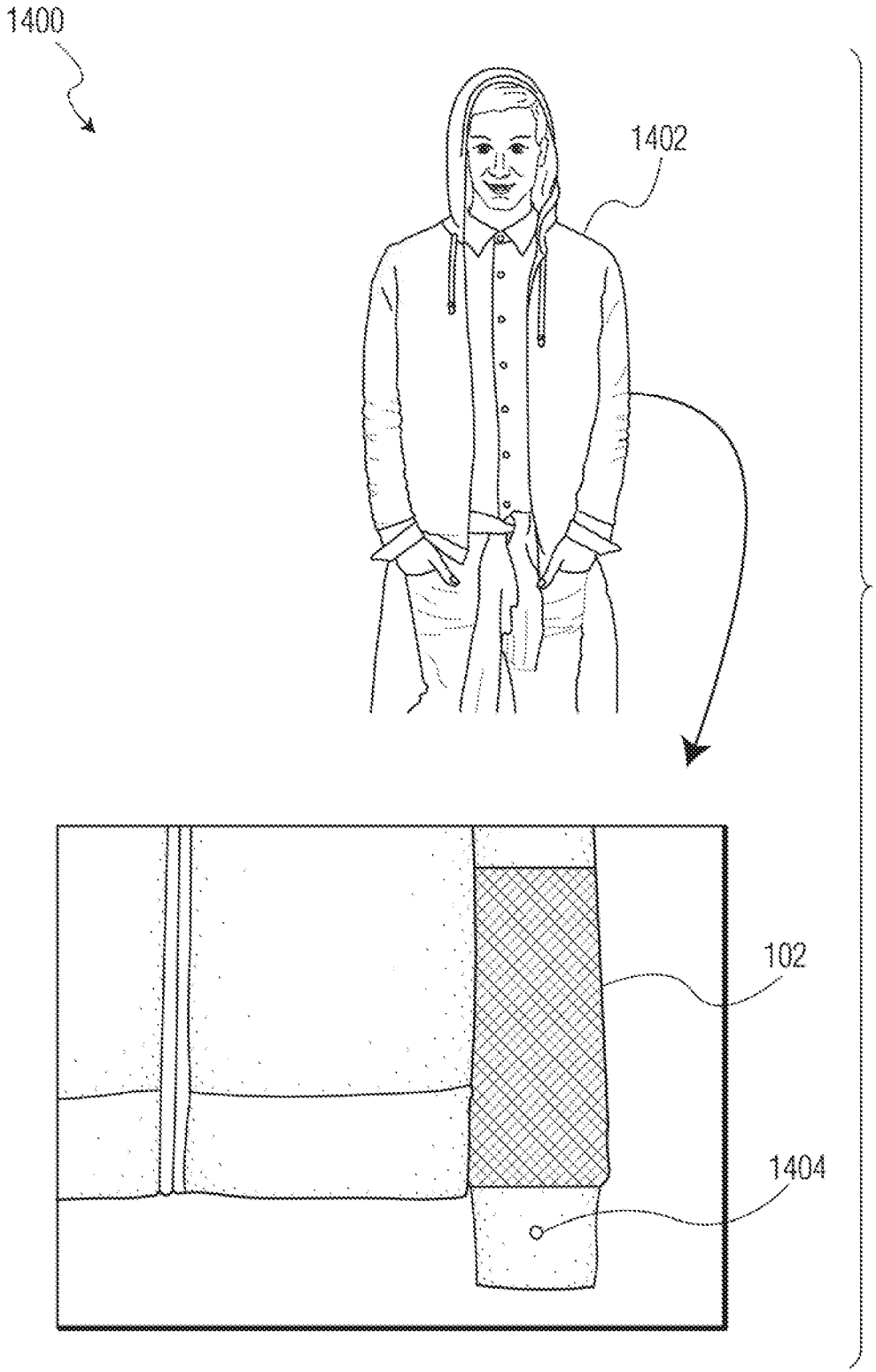
FIG. 14 illustrates an example of an interactive textile that includes an output device in accordance with one or more implementations.

FIG. 14 which illustrates an example 1400 of a jacket that includes an interactive textile 102 and an output device in accordance with one or more implementations. In this example, interactive textile 102 is integrated into the sleeve of a jacket 1402, and is coupled to a light source 1404, such as an LED, that is integrated into the cuff of jacket 1402.

Light source 1404 is configured to output light, and can be controlled by textile controller 204. For example, textile controller 204 can control a color and/or a frequency of the light output by light source 1404 in order to provide feedback to the user or to indicate a variety of different notifications. For example, textile controller 204 can cause the light source to flash at a certain frequency to indicate a particular notification associated with computing device 106, e.g., a phone call is being received, a text message or email message has been received, a timer has expired, and so forth. Additionally, textile controller 204 can cause the light source to flash with a particular color of light to provide feedback to the user that a particular gesture or input to interactive textile 102 has been recognized and/or that an associated functionality is activated based on the gesture.

Figure 15:
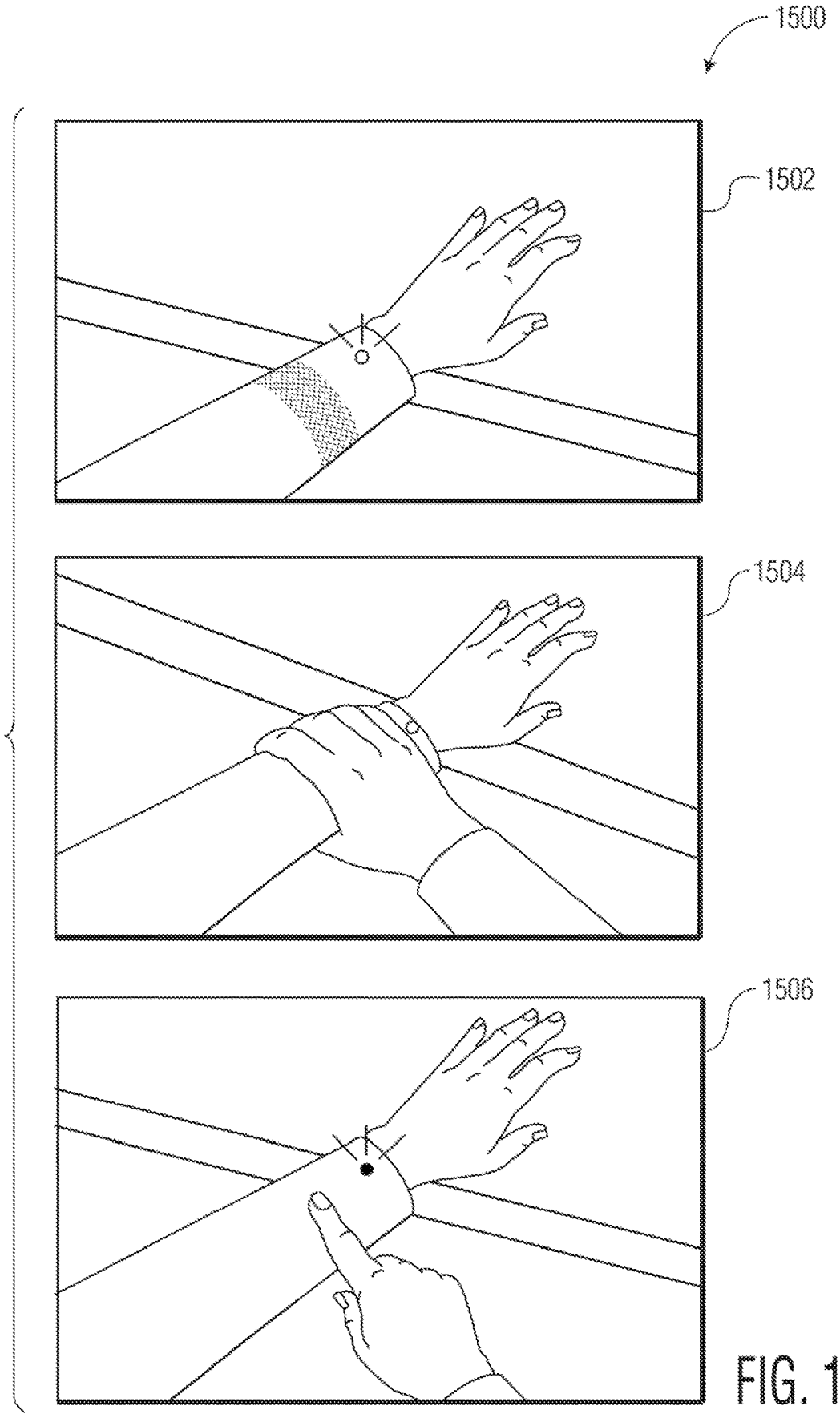
FIG. 15 illustrates implementation examples 1500 of interacting with an interactive textile and an output device in accordance with one or more implementations.

FIG. 15 illustrates implementation examples 1500 of interacting with an interactive textile and an output device in accordance with one or more implementations.

At 1502, textile controller 204 causes a light source to flash at a specific frequency to indicate a notification that is received from computing device 106, such as an incoming call or a text message.

At 1504, the user places his hand over interactive textile 102 to cover the interactive textile. This "cover" gesture may be mapped to a variety of different functionalities. For example, this gesture may be used to silence a call or to accept a call. In response, the light source can be controlled to provide feedback that the gesture is recognized, such as by turning off when the call is silenced.

At 1506, the user taps the touch sensor with a single finger to initiate a different functionality. For example, the user may be able to place one finger on the touch sensor to listen to a voicemail on computing device 106. In this case, the light source can be controlled to provide feedback that the gesture is recognized, such as by outputting orange light when the voicemail begins to play.

Having discussed interactive textiles 102, and how interactive textiles 102 detect touch-input, consider now a discussion of how interactive textiles 102 may be easily integrated within flexible objects 104, such as clothing, handbags, fabric casings, hats, and so forth.

Figure 16:
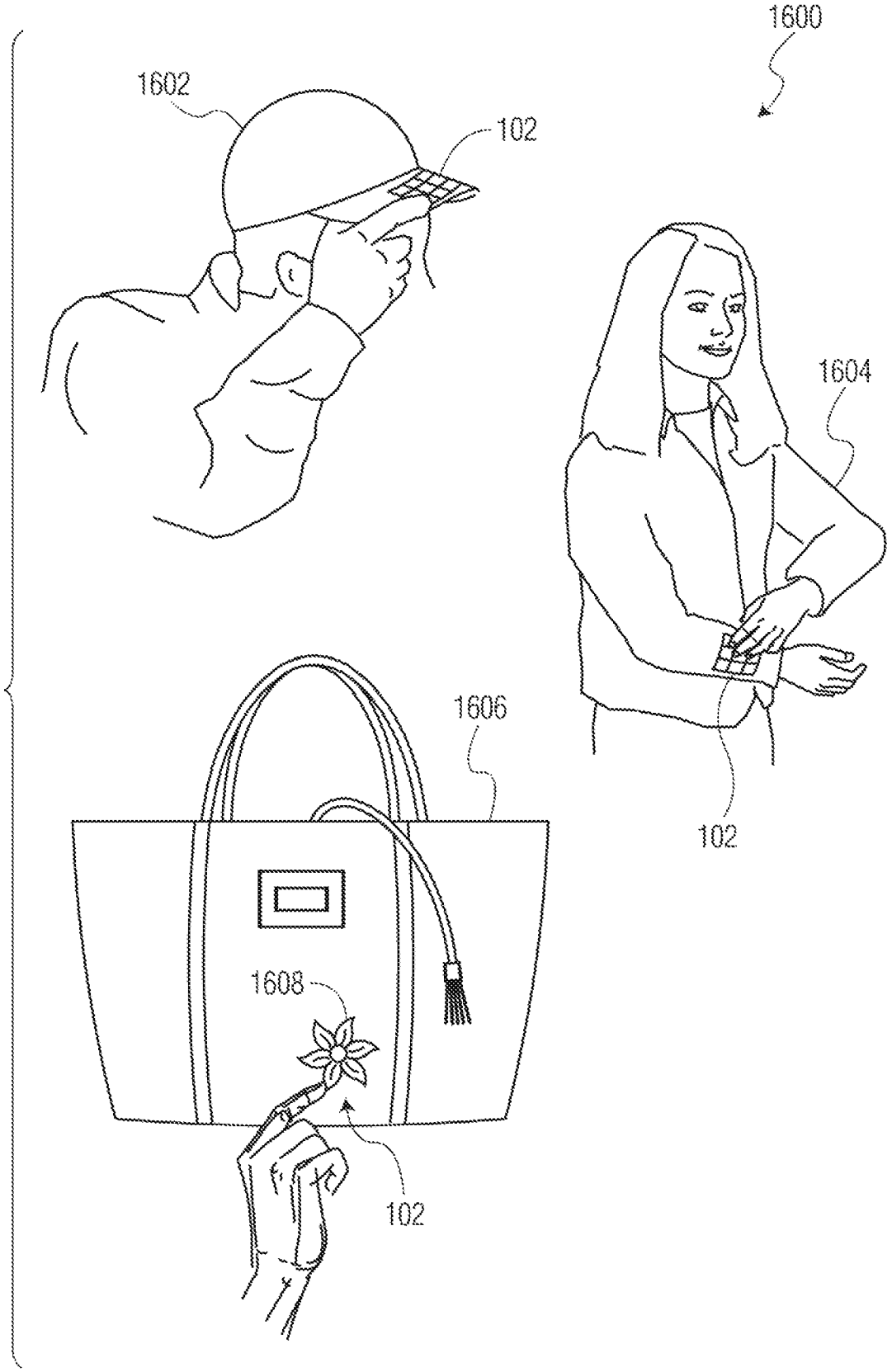
FIG. 16 illustrates various examples of interactive textiles integrated within flexible objects.

FIG. 16 illustrates various examples 1600 of interactive textiles integrated within flexible objects. Examples 1600 depict interactive textile 102 integrated in a hat 1602, a shirt 1604, and a handbag 1606.

Interactive textile 102 is integrated within the bill of hat 1602 to enable the user to control various computing devices 106 by touching the bill of the user's hat. For example, the user may be able to tap the bill of hat 1602 with a single finger at the position of interactive textile 102, to answer an incoming call to the user's smart phone, and to touch and hold the bill of hat 1602 with two fingers to end the call.

Interactive textile 102 is integrated within the sleeve of shirt 1604 to enable the user to control various computing devices 106 by touching the sleeve of the user's shirt. For example, the user may be able to swipe to the left or to the right on the sleeve of shirt 1604 at the position of interactive textile 102 to play a previous or next song, respectively, on a stereo system of the user's house.

In examples 1602 and 1604, the grid of conductive yarn 208 is depicted as being visible on the bill of the hat 1602 and on the sleeve of shirt 1604. It is to be noted, however, that interactive textile 102 may be manufactured to be the same texture and color as object 104 so that interactive textile 102 is not noticeable on the object.

In some implementations, a patch of interactive textile 102 may be integrated within flexible objects 104 by sewing or gluing the patch of interactive textile 102 to flexible object 104. For example, a patch of interactive textile 102 may be attached to the bill of hat 1602, or to the sleeve of shirt 1604 by sewing or gluing the patch of interactive textile 102, which includes the grid of conductive yarn 208, directly onto the bill of hat 1602 or the sleeve of shirt 1604, respectively. Interactive textile 102 may then be coupled to textile controller 204 and power source 206, as described above, to enable interactive textile 102 to sense touch-input.

In other implementations, conductive yarn 208 of interactive textile 102 may be woven into flexible object 104 during the manufacturing of flexible object 104. For example, conductive yarn 208 of interactive textile 102 may be woven with non-conductive threads on the bill of hat 1602 or the sleeve of a shirt 1604 during the manufacturing of hat 1602 or shirt 1604, respectively.

In one or more implementations, interactive textile 102 may be integrated with an image on flexible object 104. Different areas of the image may then be mapped to different areas of capacitive touch sensor 202 to enable a user to initiate different controls for computing device 106, or application 216 at computing device 106, by touching the different areas of the image. In FIG. 16, for example, interactive textile 102 is weaved with an image of a flower 1608 onto handbag 1606 using a weaving process such as jacquard weaving. The image of flower 1608 may provide visual guidance to the user such that the user knows where to touch the handbag in order to initiate various controls. For example, one petal of flower 1608 could be used to turn on and off the user's smart phone, another petal of flower 1608 could be used to cause the user's smart phone to ring to enable the user to find the smart phone when it is lost, and another petal of flower 1608 could be mapped to the user's car to enable the user to lock and unlock the car.

Similarly, in one or more implementations interactive textile 102 may be integrated with a three-dimensional object on flexible object 104. Different areas of the three-dimensional object may be mapped to different areas of capacitive touch sensor 202 to enable a user to initiate different controls for computing device 106, or application 216 at computing device 106, by touching the different areas of the three-dimensional object. For example, bumps or ridges can be created using a material such as velvet or corduroy and woven with interactive textile 102 onto object 104. In this way, the three-dimensional objects may provide visual and tactile guidance to the user to enable the user to initiate specific controls. A patch of interactive textile 102 may be weaved to form a variety of different 3D geometric shapes other than a square, such as a circle, a triangle, and so forth.

In various implementations, interactive textile 102 may be integrated within a hard object 104 using injection molding. Injection molding is a common process used to manufacture parts, and is ideal for producing high volumes of the same object. For example, injection molding may be used to create many things such as wire spools, packaging, bottle caps, automotive dashboards, pocket combs, some musical instruments (and parts of them), one-piece chairs and small tables, storage containers, mechanical parts (including gears), and most other plastic products available today.

Example Computing System

Figure 17:
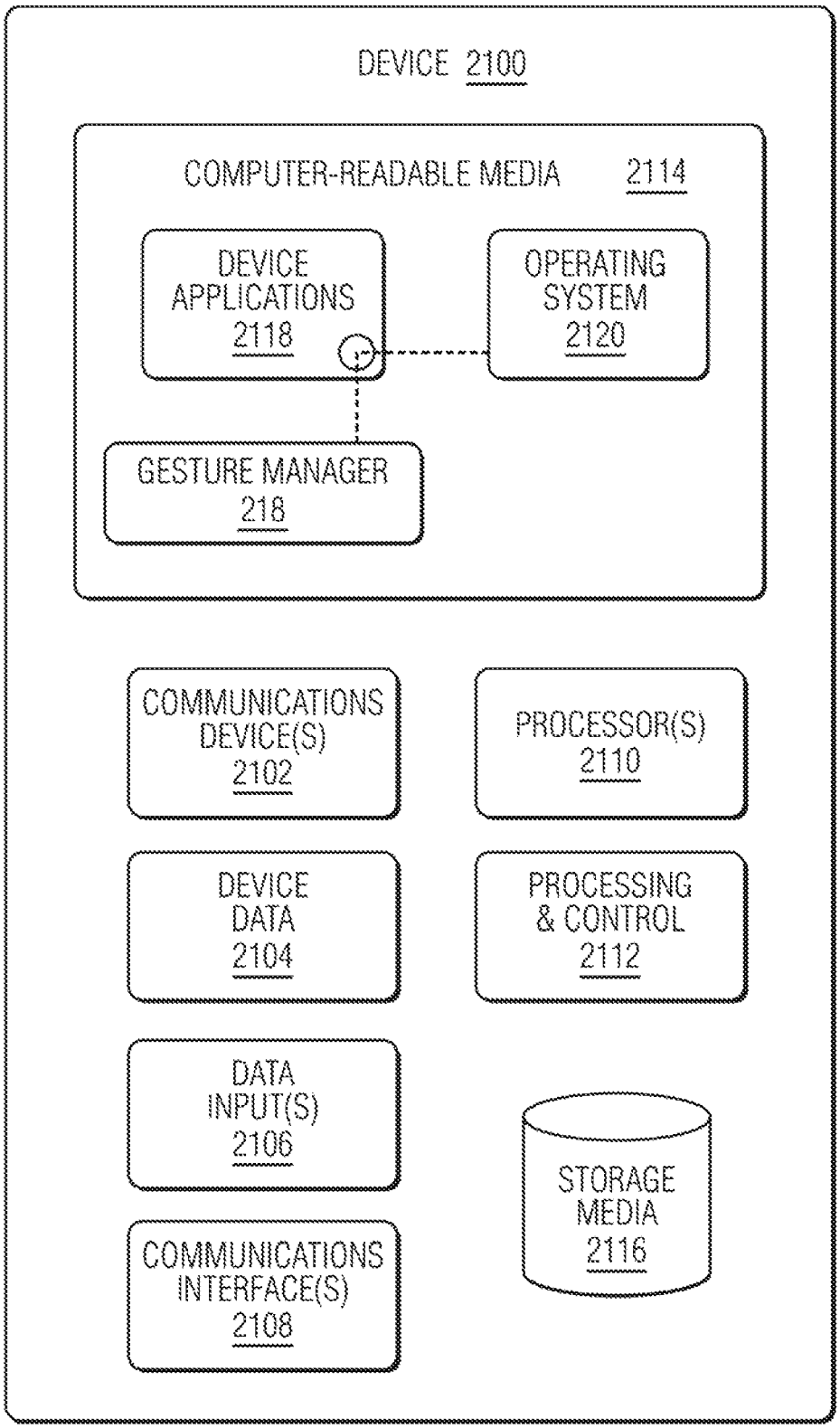
FIG. 17 illustrates various components of an example computing system that can be implemented as any type of client, server, and/or computing device as described with reference to the previous FIGS. 1-16 to implement conductive yarn for interactive textiles.

FIG. 17 illustrates various components of an example computing system 2100 that can be implemented as any type of client, server, and/or computing device as described with reference to the previous FIGS. 1-16 to implement conductive yarn for interactive textiles. In embodiments, computing system 2100 can be implemented as one or a combination of a wired and/or wireless wearable device, System-on-Chip (SoC), and/or as another type of device or portion thereof. Computing system 2100 may also be associated with a user (e.g., a person) and/or an entity that operates the device such that a device describes logical devices that include users, software, firmware, and/or a combination of devices.

Computing system 2100 includes communication devices 2102 that enable wired and/or wireless communication of device data 2104 (e.g., received data, data that is being received, data scheduled for broadcast, data packets of the data, etc.). Device data 2104 or other device content can include configuration settings of the device, media content stored on the device, and/or information associated with a user of the device. Media content stored on computing system 2100 can include any type of audio, video, and/or image data. Computing system 2100 includes one or more data inputs 2106 via which any type of data, media content, and/or inputs can be received, such as human utterances, touch data generated by interactive textile 102, user-selectable inputs (explicit or implicit), messages, music, television media content, recorded video content, and any other type of audio, video, and/or image data received from any content and/or data source.

Computing system 2100 also includes communication interfaces 2108, which can be implemented as any one or more of a serial and/or parallel interface, a wireless interface, any type of network interface, a modem, and as any other type of communication interface. Communication interfaces 2108 provide a connection and/or communication links between computing system 2100 and a communication network by which other electronic, computing, and communication devices communicate data with computing system 2100.

Computing system 2100 includes one or more processors 2110 (e.g., any of microprocessors, controllers, and the like), which process various computer-executable instructions to control the operation of computing system 2100 and to enable techniques for, or in which can be embodied, interactive textiles. Alternatively or in addition, computing system 2100 can be implemented with any one or combination of hardware, firmware, or fixed logic circuitry that is implemented in connection with processing and control circuits which are generally identified at 2112. Although not shown, computing system 2100 can include a system bus or data transfer system that couples the various components within the device. A system bus can include any one or combination of different bus structures, such as a memory bus or memory controller, a peripheral bus, a universal serial bus, and/or a processor or local bus that utilizes any of a variety of bus architectures.

Computing system 2100 also includes computer-readable media 2114, such as one or more memory devices that enable persistent and/or non-transitory data storage (i.e., in contrast to mere signal transmission), examples of which include random access memory (RAM), non-volatile memory (e.g., any one or more of a read-only memory (ROM), flash memory, EPROM, EEPROM, etc.), and a disk storage device. A disk storage device may be implemented as any type of magnetic or optical storage device, such as a hard disk drive, a recordable and/or rewriteable compact disc (CD), any type of a digital versatile disc (DVD), and the like. Computing system 2100 can also include a mass storage media device 2116.

Computer-readable media 2114 provides data storage mechanisms to store device data 2104, as well as various device applications 2118 and any other types of information and/or data related to operational aspects of computing system 2100. For example, an operating system 2120 can be maintained as a computer application with computer-readable media 2114 and executed on processors 2110. Device applications 2118 may include a device manager, such as any form of a control application, software application, signal-processing and control module, code that is native to a particular device, a hardware abstraction layer for a particular device, and so on.

Device applications 2118 also include any system components, engines, or managers to implement interactive textiles. In this example, device applications 2118 include gesture manager 218.

Although embodiments of techniques using, and objects including, conductive yarn for interactive textiles have been described in language specific to features and/or methods, it is to be understood that the subject of the appended claims is not necessarily limited to the specific features or methods described. Rather, the specific features and methods are disclosed as example implementations of conductive yarn for interactive textiles.

What is claimed is:

1. A conductive yarn configured to be integrated into an interactive textile, the conductive yarn comprising:

a conductive core comprising a plurality of conductive filaments, wherein each conductive filament of the plurality of conductive filaments is made from a metallic material comprising an alloy of copper and silver, wherein there is more copper than silver in each conductive filament of the plurality of conductive filaments; and an outer cover layer surrounding the conductive core comprising the plurality of conductive filaments.

2. A conductive yarn as defined in claim 1, wherein the conductive core contains from 8 to 18 conductive filaments.

3. A conductive yarn as defined in claim 1, wherein the metallic material used to make the conductive filament comprises the copper and silver alloy only containing copper and silver.

4. A conductive yarn as defined in claim 1, wherein each conductive filament of the plurality of conductive filaments are made from the metallic material.

5. A conductive yarn as defined in claim 1, wherein each conductive filament of the plurality of conductive filaments comprises an insulating sheath surrounding such conductive filament.

6. A conductive yarn as defined in claim 5, wherein the insulating sheath comprises a polymer layer that forms a tubular structure around such conductive filament.

7. A conductive yarn as defined in claim 6, wherein the polymer layer comprises a polyurethane polymer.

8. A conductive yarn as defined in claim 1, wherein the metallic material used to make the conductive filament contains from 1% by weight to 40% by weight silver.

9. A conductive yarn as defined in claim 1, wherein the metallic material used to make the conductive filament contains from 8% by weight to 15% by weight silver.

10. A conductive yarn as defined in claim 1, wherein silver is present in the copper and silver alloy in an amount from 10% to 14% by weight.

11. A conductive yarn as defined in claim 1, wherein each conductive filament of the plurality of conductive filaments has a diameter of from 0.02 mm to 0.1 mm.

12. A conductive yarn as defined in claim 1, wherein a filament diameter is between 0.12 mm and 0.01 mm.

13. A conductive yarn as defined in claim 1, wherein the conductive yarn is made from 8 to 18 conductive filaments.

14. A conductive yarn as defined in claim 1, wherein the outer cover layer comprises flexible threads braided around the conductive core.

15. A conductive yarn as defined in claim 14, wherein the flexible threads comprise silk threads, polyester threads, cotton threads, wool threads, or nylon threads.

16. A conductive yarn as defined in claim 14, wherein the flexible threads comprise pre-shrunk polyester threads.

17. A conductive yarn as defined in claim 1, wherein the cover layer is made from preshrunk threads, the preshrunk threads, having a size of between 100 denier and 20 denier.

18. A conductive yarn as defined in claim 1, wherein the conductive core comprises less than ten twists per meter.

19. An interactive textile integrated with a flexible object, the interactive textile comprising a plurality of conductive yarns woven into the interactive textile to form a capacitive touch sensor, the conductive yarns comprising the conductive yarn as defined in claim 1; and a textile controller coupled to the capacitive touch sensor, the textile controller configured to detect touch-input to the capacitive touch sensor when an object touches the capacitive touch sensor, and process the touch-input to provide touch data useable to control a computing device or an application at the computing device.

20. An interactive textile as defined in claim 19, wherein a gesture manager is implemented with the computing device.

21. An interactive object comprising a conductive yarn configured to be integrated into an interactive textile, the conductive yarn comprising:

a conductive core comprising from a plurality of conductive filaments, each conductive filament of the plurality of conductive filaments is made from a metallic material comprising an alloy of copper and silver, wherein there is more copper than silver in each conductive filament of the plurality of conductive filaments; and an outer cover layer surrounding the conductive core, the cover layer comprising flexible threads braided around the conductive core comprising the plurality of conductive filaments.

22. A conductive yarn as defined in claim 21, wherein the conductive core contains from 10 to 14 conductive filaments.

23. A conductive yarn as defined in claim 21, wherein each conductive filament has a diameter of from 0.02 mm to 0.1 mm.

24. A conductive yarn as defined in claim 21, wherein the metallic material used to make each conductive filament of the plurality of conductive filaments contains from 8% by weight to 15% by weight silver.

25. A conductive yarn as defined in claim 21, wherein each conductive filament of the plurality of conductive filaments is surrounded by a polymeric insulating layer.

* * * * *